United States Patent [19]

Chapin

[11] Patent Number: 4,703,572

[45] Date of Patent: Nov. 3, 1987

[54] ANIMATED ULTRAVIOLET DISPLAY APPARATUS

[76] Inventor: William L. Chapin, 2410 W. Palm Ave., Orange, Calif. 92668

[21] Appl. No.: 789,472

[22] Filed: Oct. 21, 1985

Related U.S. Application Data

[62] Division of Ser. No. 423,991, Sep. 27, 1982, Pat. No. 4,565,022.

[51] Int. Cl.[4] ..... G09F 13/00

[52] U.S. Cl. ..... 40/442; 250/461.1; 40/443; 40/427; 40/541; 40/465

[58] Field of Search ..... 40/443, 427, 442, 541, 40/465; 250/461.1

[56] References Cited

U.S. PATENT DOCUMENTS

| | | | |
|---|---|---|---|
| 2,040,538 | 5/1936 | Smith | 40/444 |
| 2,165,974 | 7/1939 | Land | 40/548 |
| 2,168,113 | 8/1939 | Best | 40/444 |
| 2,169,022 | 8/1939 | Chubb | 40/548 |
| 2,178,462 | 10/1939 | Armstrong | 40/444 |
| 2,882,631 | 4/1959 | Boone | 40/548 |
| 3,350,803 | 11/1967 | Stockwell | 40/548 |
| 3,438,022 | 4/1969 | Teeg | 40/442 |
| 3,499,240 | 3/1970 | Cotton et al. | 40/443 |
| 4,016,450 | 4/1977 | Balekjian | 40/543 |
| 4,565,022 | 1/1986 | Chapin | 40/442 |

*Primary Examiner*—Gene Mancene
*Assistant Examiner*—Wenceslao J. Contreras
*Attorney, Agent, or Firm*—William L. Chapin

[57] ABSTRACT

A method and apparatus for animating illuminated signs and displays comprises sequentially illuminating with at least one source of radiant energy of a particular wavelength range at least two planar scenes, or three-dimensional objects, visibly responsive to radiant energy of the particular wavelength range used. Means are provided for shielding a non-selected planar scene or object from illumination during the time a selected planar scene or object is illuminated. In the preferred embodiment, invisible ultraviolet illumination is used to cause a plurality of scene-views to fluoresce visibly in a timed sequence which produces a visual sensation of apparent motion from one scene-view to another of an object depicted by the scene-views. Subjective brightness of scene-views may be enhanced by modulating the illumination of a scene at a perceptibly low frequency.

30 Claims, 36 Drawing Figures

ANIMATED ULTRAVIOLET DISPLAY APPARATUS

Division of Ser. No. 423,991, filed Sept. 27, 1982, now U.S. Pat No. 4,565,022.

BACKGROUND OF THE INVENTION (a) Field of the Invention

The present invention relates to animated signs and displays and more particularly to those signs and displays in which an animation effect is produced by sequential illumination of the various views of a scene comprising the complete display scene.

(b) Description of The Prior Art

Hilgenberg, in U.S. Pat. No. 1,930,359, Oct. 10, 1933, discloses the use of two transparent sheets with sand-blasted alternate views of a scene. The sheets are alternately edge-illuminated with two tubular gas-discharge lamps to produce the visual sensation of motion of the object depicted from one scene position to the other scene position.

Rupp, in U.S. Pat. No. 2,107,767, February 8, 1938, discloses the use of an electromagnetically operated ratchet to interpose various colored filter glasses between the edge of a glass panel bearing sand-blasted messages and a tubular lamp illuminating the edge of the glass panel.

Ward, in U.S. Pat. No. 2,015,170, Sept. 24, 1935, discloses the use of visible light and short-wave ultraviolet light to alternately illuminate a sign. One scene on the sign is visible in ordinary white light, while a second scene rendered in short-wave ultraviolet responsive phosphors is deposited over the visible image. According to Ward, illuminating the sign with short-wave ultraviolet radiation "will render the secondary (u.v. responsive) design luminous to the extent of almost, if not quite completely, obscuring the colors of the primary (visible) design."

Herberger, in U.S. Pat. No. 2,223,685, Dec. 3, 1940, discloses use of an opaque perforated panel containing one view of a scene, and a solid translucent panel positioned behind the perforated panel and containing a second view. The front panel is illuminated by ambient light or a light source positioned so as to illuminate the front panel at high angles of incidence. Intermittent illumination of the translucent rear panel by a light source behind it makes the scene contained on the rear panel visible, and the scene on the front panel less visible because of the higher surface brightness of the rear scene.

Switzer, in U.S. Pat. No. 2,689,917, Sept. 21, 1954, uses "fluorescigenous" illumination (unfiltered black light, 3500 Å–4500 Å) to edge-illuminate an ultraviolet-transmission panel. The illumination is trapped in the panel by total internal reflection except where the reflection is frustrated by fluorescent paint applied to the surface in the form of "indicia", i.e., figures and advertising messages.

Davis, in U.S. Pat. No. 3,399,476, Sept. 3, 1968, discloses the use of vertical tubular lamps to edge-illuminate a vertical stack of three horizontal rows of transparent slabs bearing messages. Each slab consists of three transparent sheets laminated together and bearing different visible figures. A tubular motor-driven shutter containing vertical apertures is positioned coaxially over the tubular lamp. Rotation of the shutter causes successive illumination of front, middle and rear sheets in the top slab, followed by sequential illumination of the sheets in the middle slab, and finally by the sequential illumination of the sheets in the bottom slab.

Frois, in U.S. Pat. No. 4,244,130, Jan. 13, 1981, discloses the use of a horizontally positioned tubular lamp within an enclosing, motor driven coaxial cylinder. The shield contains an array of identical longitudinal slots positioned around the circumference of the cylinder. Light from the tubular lamp sequentially illuminates a stack of parallel, vertically-positioned acrylic sheets. The sheets have vertically staggered patterns of concave depressions simulating bubbles on successive sheets in the stack. The cross-sectional shape of the sheets is in the form of a bottle, and sequential illumination of the sheets produces the visual impression of bubbles rising in the bottle.

BRIEF SUMMARY OF THE INVENTION

In the basic embodiment of the present invention, two long-wave ultraviolet (u.v.) lamps are used to alternately illuminate fluorescent scenes or three-dimensional objects placed on either side of a panel that is transparent to visible light but opaque to ultraviolet light. The scenes may be painted or silk-screened directly onto opposite sides of the u.v.-absorbing panel. Various colored fluorescent tempera paints and fluorescent inks responsive to long-wave ultraviolet illumination are readily available for this application. In those applications where it is desired to change the animated scene, for example from a Thanksgiving subject to a Christmas subject, the views of the scene may be painted or silk screened onto flexible transparent sheet stock. The sheet stock need not be u.v.-absorbing if placed on either side of a u.v.-absorbing panel. Low-cost vinyl or "acetate" (cellulose acetate butyrate) sheet stock having a thickness of 1 to 5 mils may be used.

Three-dimensional objects treated with fluorescent dyes or coatings and placed on opposite sides of the u.v. absorbing panel may also be used with the present invention.

The two ultraviolet lamps illuminating the two views of the scene on opposite sides of the u.v.-absorbing panel are controlled by an electronic sequence controller which alternately energizes the two lamps.

ADVANTAGES OVER THE PRIOR ART

The present invention can utilize readily interchangeable scenes printed on cheap plastic sheet stock to change the animation subject as often as desired. The interchangeable scenes may be used with a fixed sign system comprising an ultra-violet absorbing transparent panel, two or more ultraviolet lamps, and an electronic sequence controller which controls the pattern and frequency of the energization of the ultraviolet lamps. The present invention can produce animated scenes in an unlimited variety of bright colors, and can depict animation of photographically produced scenes with photographic quality by use of silkscreen printed scene-views.

Also, the present invention dispenses with the requirement for mechanical actuation devices that have inherent cost, reliability, noise and maintainability disadvantages when compared with the solid-state electronic sequence control employed in the present invention.

In contrast with Hilgenberg, the present invention dispenses with the requirement for producing sceneviews by sand-blasting, which has inherent cost, lack of changeability and image resolution problems.

Unlike Ward and Herberger, the present invention produces scene-views of equal brightness and contrast ratio, making the present invention capable of producing a visually convincing impression of scene animation.

Neither Rupp or Switzer teaches or suggests methods for producing animated images.

Davis and Frois disclose methods for producing changing scenes that require mechanical movements of varying complexity. Neither teaches a method for readily changing the subject to be animated.

OBJECTS OF THE INVENTION

An object of the present invention is to provide a method and apparatus for producing animation effects in signs and displays.

Another object of the invention is to provide means for producing animation effects in signs and displays without requiring actual movement of any element of the scene.

Another object of the invention is to provide a method and apparatus for producing animated displays suitable for use with displays ranging in size from small point-of-purchase displays of approximately one square foot to billboard, on-site or window displays of several hundred square feet.

Another object of the invention is to provide a method and apparatus for animating signs and displays that permits rapid and convenient changing of the subject to be animated.

Another object of the invention is to provide a method and apparatus for animating signs and displays that permits the animation subject to be economically changed.

Another object of the invention is to provide a method and apparatus for producing high-resolution animated displays.

Another object of the invention is to provide a method and apparatus for producing animated displays employing photographically reproduced subjects.

Another object of the invention is to provide a method and apparatus capable of producing animated displays providing a sensation of motion parallel to an observers line of sight as well as perpendicular to the line of sight.

Another object of the invention is to provide a method and apparatus capable of producing animation effects using three-dimensional objects as well as planar scenes.

Another object of the invention is to provide a method and apparatus capable of sequentially displaying two or more views of a scene.

Another object of the invention is to provide a method and apparatus for producing animation effects by the sequential energization of two or more radiation sources.

Another object of the invention is to provide a method and apparatus for producing animation effects without requiring any physical motion of the apparatus.

Another object of the invention is to provide a method and apparatus for producing animation effects by the sequential display of a plurality of images each having a substantially equivalent, high brightness and contrast ratio.

Another object of the invention is to provide a method and apparatus for producing animation effects by selected irradiation of different views of the scene subject.

Another object of the invention is to provide a method and apparatus for producing animation effects by selected ultraviolet irradiation of fluorescent scene-views or objects.

Various other objects and advantages of the present invention, and the most novel features, will be particularly pointed out hereinafter in connection with the appended claims.

It is to be understood that although the invention disclosed herein is fully capable of achieving the objects and providing the advantages mentioned, the structural and operational characteristics of the invention described herein are merely illustrative of the preferred embodiments. Accordingly, I do not intend the scope of my exclusive rights and privileges in the invention to be limited to the details of construction described, but only to those embodiments and their reasonable equivalents and adaptations delineated in the appended claims.

BRIEF DESCRIPTION OF THE DRAWINGS

FIG. 26 is an elevation view of the three scene views of the exemplary animation subject shown in FIG. 24.

DETAILED DESCRIPTION OF THE INVENTION

Figure 1:
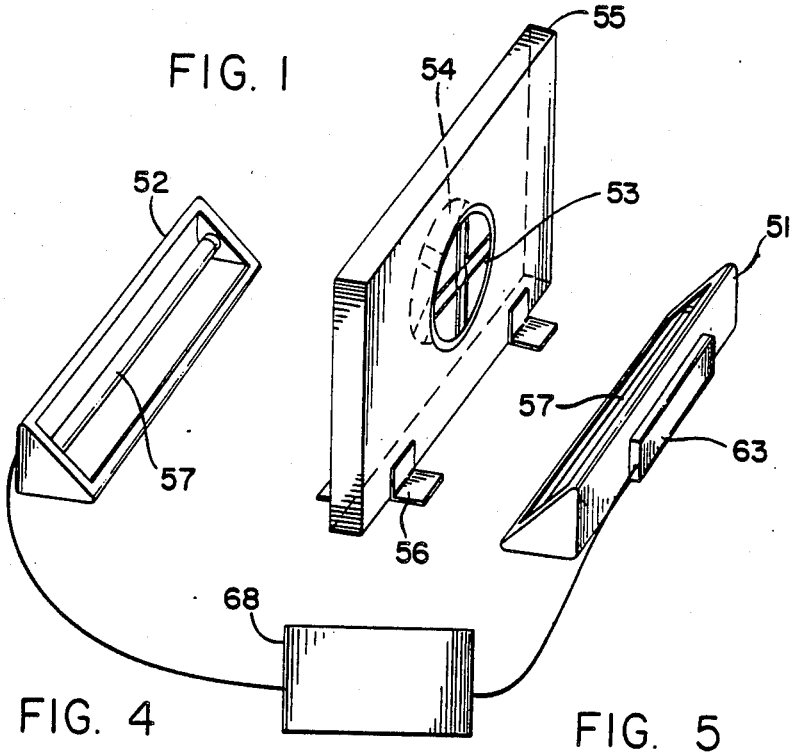
FIG. 1 is a side perspective view of the basic embodiment of the invention.

Referring now to FIG. 1, identical ultraviolet illuminators 51 and 52 are used to selectively illuminate sceneviews 53 and 54, respectively on either side of visibly transparent panel 55. Brackets 56 are used to support panel 55 in a vertical position.

Figure 2:
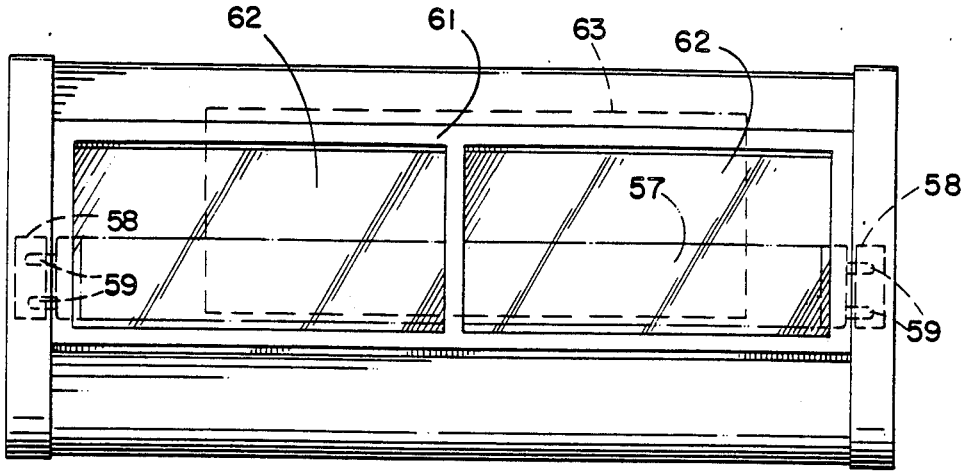
FIG. 2 is a front elevation view of one of the ultraviolet illuminators shown in FIG. 1.
Figure 3:
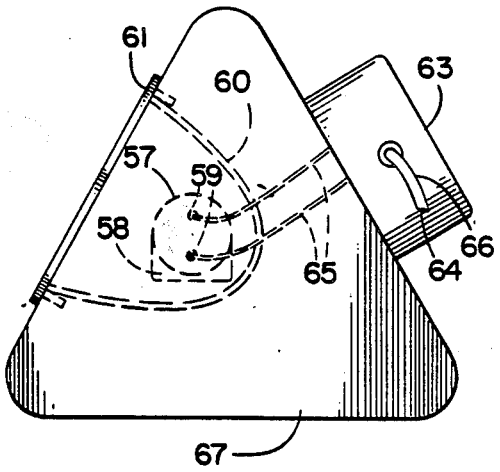
FIG. 3 is a side elevation view of an illuminator.

As may be seen by referring to FIGS. 1, 2 and 3, each illuminator 51 and 52 comprises a low-pressure mercury vapor lamp 57; sockets 58 for supporting the lamp and making electrical contact with lamp terminals 59; a coaxial cylindrical reflector 60 having a parabolic cross section mounted behind the lamp; a filter holder 61 holding glass filters 62 mounted in front of the lamp; a lamp driver or ballast module 63 having power input terminals 64; lamp driver output terminals 65 and input control terminals 66; and supporting housing 67. The lamps 57 are tubular low-pressure mercury vapor lamps internally coated with a fluorescent phosphor that converts the short-wave ultraviolet mercury vapor emission energy at 2537 Å to long-wave ultraviolet emission in the approximate range of 3000 Å to 4000 Å with a fluorescent emission peak at approximately 3600 Å. This range of long-wave ultraviolet radiation is commonly referred to as "black light" and presents no health hazards to the skin or eyes. In those applications, as in the present, where it is desired to remove the visible light emitted from the black light lamp, deep violet filter glasses 62 transmissive to long-wave ultra-violet radiation but opaque to visible radiation are placed over the lamp. Alternatively, and preferably for the present application, the lamp tubes are made of visibly opaque filter glass, eliminating the necessity for external filter glasses. Self-filtering black light lamps of the kind described are available in the same sizes and wattages as conventional visibly fluorescent tubular lamps from a number of manufacturers.

The panel 55 shown in FIG. 1 is made of a material that is highly transmissive to visible light, but highly opaque to ultraviolet radiation in the wavelength range of emission from the black light lamps. A good material for this application is ultra-violet absorbing acrylic plastic sheets available from a number of manufacturers.

Figure 4:
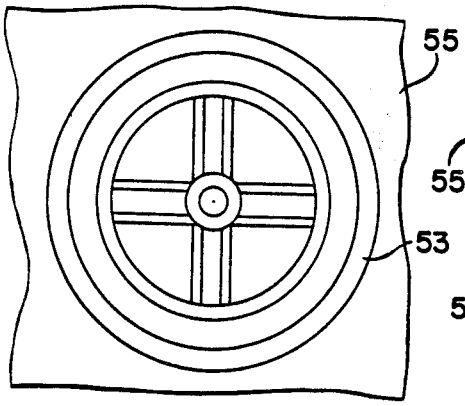
FIG. 4 is a front elevation view of the apparatus of FIG. 1 showing a scene-view of an exemplary animation subject.
Figure 5:
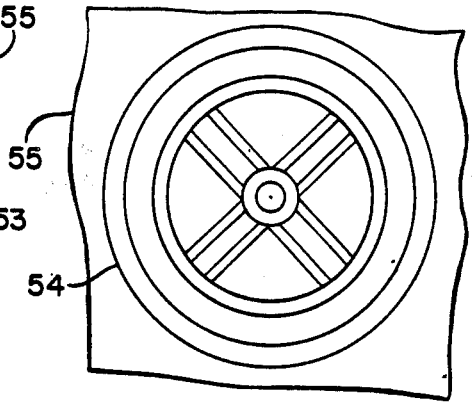
FIG. 5 is a rear elevation view of the apparatus of FIG. 1 showing a different scene-view in which the exemplary animation subject appears in a different position than in the scene-view shown in FIG. 4.

As shown in FIGS. 1, 4 and 5, alternate sceneviews 53 and 54 of the subject to be animated are painted or printed onto opposite sides of u.v. absorbing panel 55. Panel 55 is supported in a vertical position in fixed relationship to lamps 51 and 52 by brackets 56. The paints used to depict the views are selected from fluorescent paints highly responsive to long-wave ultraviolet radiation ("black-light") and are available from a large number of manufacturers.

Illuminator controller 68 comprises variable frequency oscillator and buffer circuits which are suitable for turning on and off lamp drivers 63 in ultraviolet illumination 51 and 52.

Figure 6:
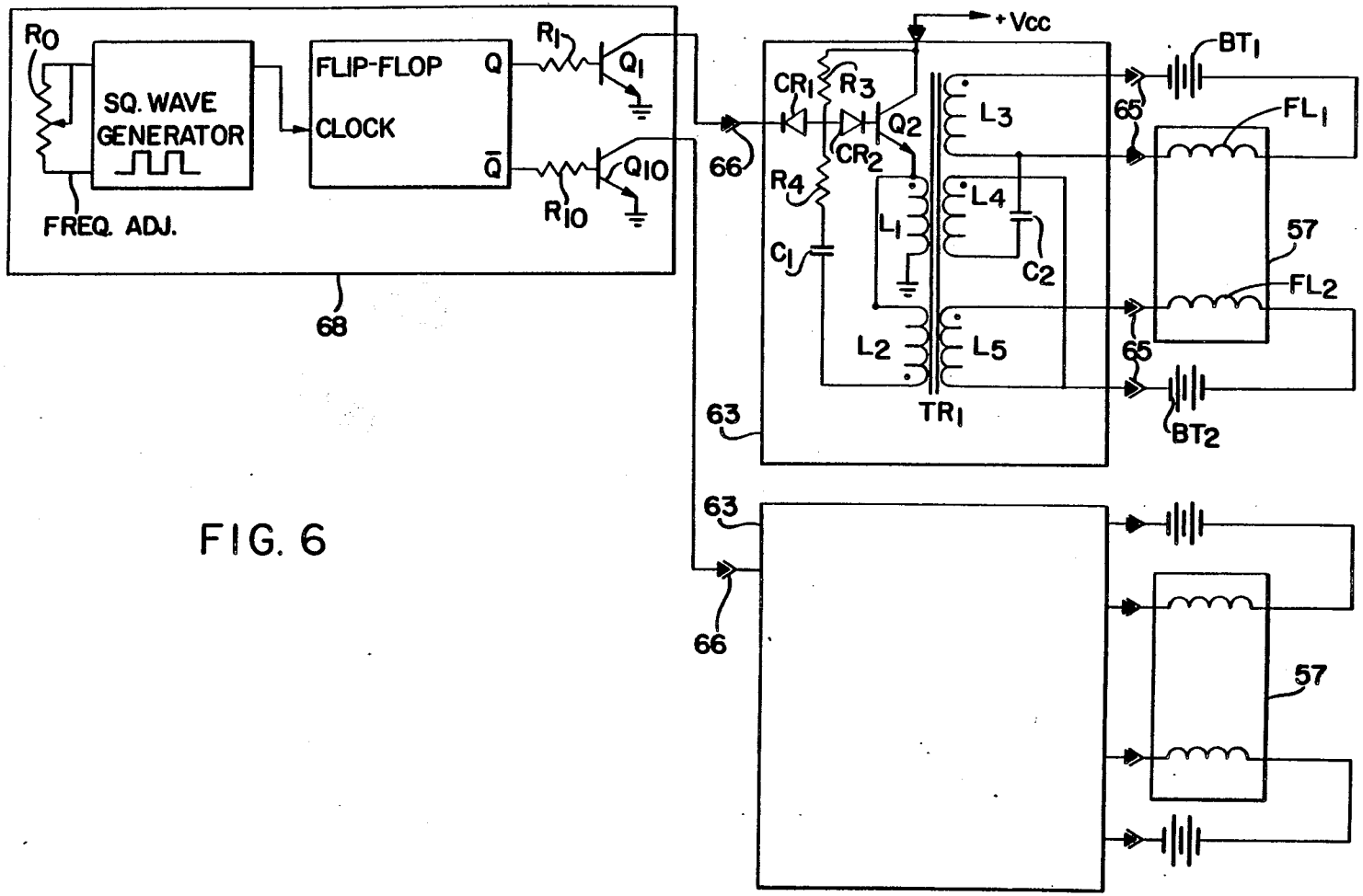
FIG. 6 is a schematic diagram of a typical illuminator controller and lamp driver circuits.

FIG. 6 is a schematic diagram of a suitable illuminator controller circuit 68 showing how it interconnects with typical fluorescent lamp drivers 63 used to energize ultraviolet lamps 57. The fluorescent lamp drivers 63 shown in FIG. 6 are commercially available solid-state inverters producing from battery voltages in the range of 6 to 12 volts high voltage alternating current required to drive fluorescent lamps. While drivers 63 are not part of the present invention, they are shown in FIG. 6 in sufficient detail to show how illuminator control circuit 68 is effective in controlling energization of lamps 57 in ultra violet illuminators 51 and 52. As shown in FIG. 6, the on and off times of illuminators 51 and 52 are controlled by a square wave generator whose output frequency may be adjusted over the approximate range of a fraction of a cycle per second to several tens of cycles per second by variable resistor R0. The output signal produced by the square wave generator is coupled to the clock input terminal of a flip-flop. The Q output of the flip-flop is connected to base drive resistor R1 of transistor Q1 configured as a commonemitter switch. When the Q output of the flip-flop is positive, transistor Q1 is turned on, causing the collector-to-emitter impedance of Q1 to attain a low value. At the same time that the Q output of the flip-flop is at a positive voltage, the complementary output of the flip-flop, $\overline{Q}$, is at a value close to zero volts, thus ensuring that transistor Q10 is in an "off", high-impendance state at the same time that transistor Q1 is in "on", low-impedance state. When a clock pulse from the square wave generator toggles the flip-flop into the alternate flip-flop state in which the $\overline{Q}$ output of the flip-flop is at a positive potential and the Q output is at a low level, Q10 is driven into a low-impedance "on" state while Q1 is turned off to a high-impedance state. When Q1 is in a low-impedance "on" state, the anode of CR1, whose cathode is coupled to the collector of Q1, is pulled down to a value of approximately one volt. That voltage is insufficient to permit base drive resistor R3 from forward biasing Q2 sufficiently to cause self-sustained oscillations to occur in the blocking-oscillator inverter comprising lamp driver 63 driving ultraviolet lamp 57. As a result, turning on transistor Q1 turns off illuminator 51. Turning off transistor Q1 permits self-sustained oscillations to be initiated and maintained in the blocking oscillator inverter, energizing the lamp when transistor Q1 is turned off. Thus, as shown in FIG. 7, illuminators 51 and 52 are alternately energized by complementary waveform signals produced by lamp control circuit 68. the duty cycle of the lamp control signals is typically 50%, as shown in FIG. 7.

As shown in FIG. 6, batteries BT1 and BT2 are connected in series with the filament driver transformer windings L3 and L5, respectively, and corresponding filaments FL1 and FL2, respectively of fluorescent lamp 57. The purpose of the batteries is to maintain the filaments at a high operating temperature even when the blocking oscillator inverter is turned off by its external control transistor. If the filaments are not maintained at a temperature sufficiently high to produce an adequate supply of electrons by thermionic emission during the turn-on portion of the electrical discharge cycle in a lamp, cathodic impact of argon and mercury atoms upon the filaments during turn-on will rapidly destroy the filaments and grossly shorten lamp life.

While the foregoing description of the illuminator controller 68 assumed for purposes of illustration and example that the fluorescent lamp drivers that it controlled were of the blocking-oscillator type, it is clear that the switching action of controller transistors Q1 and Q10 alternately between high-impedance and low-impedance states is readily adaptable to controlling other types of fluorescent lamp drivers.

When lamps 51 and 52 are alternately energized according to the timing sequence shown in FIG. 7, the scene-views depicted on opposite sides of panel 55 are alternately illuminated in unison with the lamp energization. For examaple, when view 53 is illuminated by lamp 51, an observer viewing panel 55 perpendicularly from the right will see a wheel and axle end with one pair of spokes vertically oriented and a second pair of spokes horizontally oriented. Since the ultraviolet radiation from lamp 51 which causes the fluorescent illumination of scene 53 is blocked by u.v. absorbing panel 55, scene-view 54 on the rear of panel 55 remains dark during the time that lamp 51 is turned on and lamp 52 is turned off.

In an exactly analogous fashion, turning lamp 51 off and lamp 52 on causes the fluorescent illumination of scene-view 54 alone. In that scene-view, the observer will see a wheel and axle end with one pair of spokes rotated 45 degrees from a vertical axis and one pair of spokes rotated 45 degrees from a horizontal axis. Thus, alternate energization of lamps 51 and 52 causes the wheel to appear to rotate back and forth plus and minus 45 degrees. While the ideal frequency of alternation of scene-views affording the best visual sensation of motion varies as a function of scene subject, a good typical alternation frequency is one to two cycles per second, although alternation frequencies ranging from about one-fifth of a cycle per second to 10 cycles per second are effective, depending upon the scene subject to be animated.

In the exemplary subject scene-views shown in FIGS. 53 and 54, the wheel and axle end are painted in outline form on opposite sides of panel 55. That permits viewing scene-view 54 through the open spaces in scene-view 53 when scene-view 53 is dark and scene-view 54 is illuminated. Similarly, an observer on the left hand side of panel 55 is able to see scene-view 53 through the open spaces in scene view 54 when scene-view 54 is dark and scene-view 53 is illuminated. Using this open-space method of scene depiction, if the scene is to be viewed only from the front, the front scene-view 53 may be applied to panel 55 with opaque fluorescent paint. On the other hand, the rear scene-view 54 must be applied with a fluorescent material that is transparent to fluorescent light induced in the material, to permit that light to be viewable by an observer in front of the panel. Thus, if the rear scene-view is applied with a paint containing fluorescent pigments, the thickness of the paint coating must be sufficiently small to ensure that the visible fluorescence induced in the pigment in the outer layers of the coating is not excessively attenuated by absorption of pigments contained in the inner layers.

In summary, if the scene-views are applied to the u.v. absorbing panel with a fluorescent paint that contains a pigment, care must be taken to control the thickness of the rear coating of paint, while the front scene-view can be applied with a coating that is as thick and opaque as desired. Of course, if it desired to make the animated display viewable from the rear as well as the front, thickness of both front and rear coatings must be controlled.

If the scene-views are applied to the ultravioletabsorbing panel with inks containing fluorescent dyes rather than with paints containing fluorescent pigments, the requirement for controlling the coating thickness is minimized, since inks containing fluorescent dyes are substantially transparent to the induced fluorescence.

To eliminate the necessity for providing large spaces in the front scene-view to allow viewing of the rear scene, the front scene-view may be applied in such a manner as to leave a regular pattern of very small circular holes or other clear spaces in the front scene-view. The hole size and spacing is selected to be sufficiently small as to be virtually imperceptible to a viewer, at a desired distance, yet permitting the rear scene to show through the hole pattern. If the front scene-view is painted directly onto the u.v. absorbing panel, a perforated screen may be placed flush with the front surface during the process of painting the scene-view. When the paint has dried, the screen can be removed, leaving the desired pattern of clear spaces in the finished scene-view. Thus, using a pattern of small holes in a scene-view permits the use of scene-views that appear solid to a distant observer.

In many applications of the present invention, it would be desirable to permit changing the subject to be animated at relatively frequent intervals. That capability can be achieved by applying the alternate scene-views to thin, transparent plastic sheets which are then fastened flush with the front and rear surfaces, respectively, of the u.v. absorbing panel. The plastic sheets need only to be transparent to the visible fluorescence induced in the coatings applied to the surfaces of the sheets, and need not be opaque to ultraviolet light. Low-cost vinyl or "acetate" (cellulose acetate butyrate) sheets are ideal for this purpose. The vinyl and acetate sheets have the additional advantage of being well suited to imprinting with fluorescent ink by silk-screening techniques.

In certain sign and display applications, it may be desired to alternately illuminate the respective sceneviews at a slow rate. Also, certain applications may call for the intermittent illumination of a single scene-view. For both of those categories of applications, the subjective brightness of the illuminated scene-views may be enhanced by a technique now to be described.

If the eye is presented with an intermittent source of light at a relatively low frequency of intensity fluctuation (from less than 1 HZ to about 20 HZ), the sensible response of the eye to the pulsating light source is not merely proportional to the average intensity of the source, as it is for steady light sources and higher frequency light sources (Talbot's Law). Instead, the sensible response to a pulsating light source can be three times or more as great as the response to a non-fluctuating or high-frequency light source with the same average intensity. The pulsation waveform most effective in producing brightness enhancement has been found to be a 50% duty-cycle square wave. The following text books contain a description of this phenomenon, known as brightness enhancement: (1) Graham, Clarence H. (Ed); *Vision and Visual Perception,* New York, John Wiley and Sons, 1965, pp. 301–302, (2) Hunt, Walsh and Hunt, *Light, Colour and Vision,* London, Chapman and Hall, Ltd., 1957.

Figure 7A:
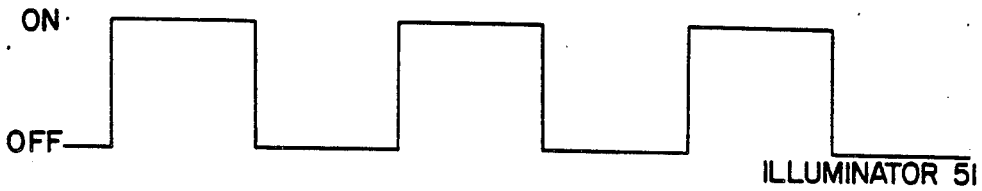
FIGS. 7A thru 7E show timing sequence diagrams for the energization of the lamps shown in FIG. 1.
Figure 7B:
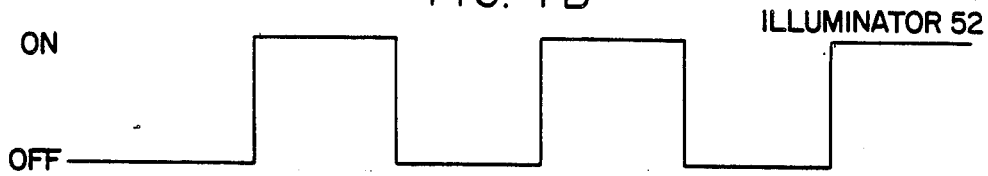
Figure 7C:
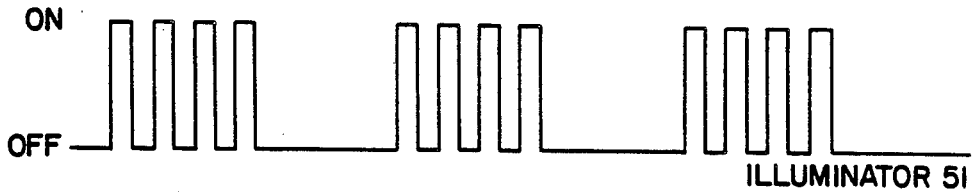
Figure 7D:
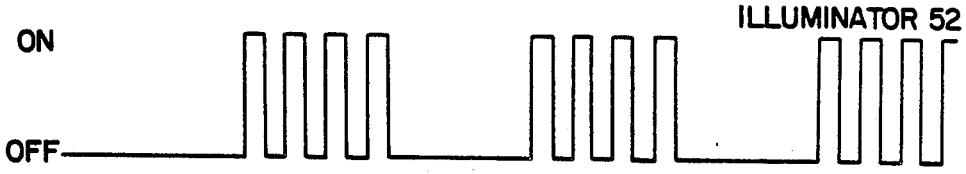

The physiological phenomenon of brightness enhancement has been found effective in increasing the apparent brightness of the displayed signs constructed as described in this specification. As shown in FIGS. 7C and 7D, the square-wave on-off control signal for the scene-view illuminators can be modulated with a 50% duty-cycle square wave having a higher frequency. The modulation frequency is selected to lie within the frequency range effective in producing brightness enhancement, i.e., frequencies from a fraction of a cycle per second up to the critical fusion or flicker frequency for humans. The critical fusion frequency is that frequency at which a human observer can no longer perceive intensity fluctuations in a light source, and varies with the intensity of the source and the ambient light background. Typically, the critical fusion frequency ranges from about 20 cycles per second up to 60 cycles per second. Thus, modulating the illumination source for a display scene-view with a square wave having a frequency of a faction of a cycle per second to several tens of cycles per second will enhance the apparent brightness of the scene-view. The optimum frequency range producing the greatest brightness enhancement was found by testing to lie in the approximate frequency range of one to ten cycles per second.

Figure 7E:
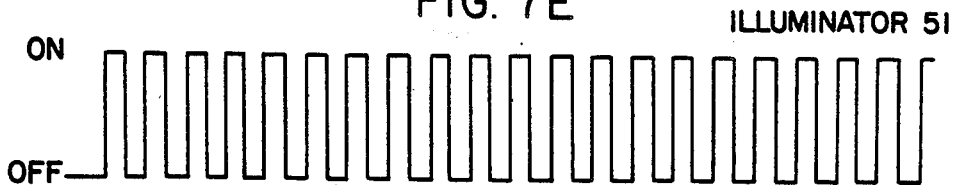

The apparent brightness of a single scene-view display can also be enhanced by modulating the illumination source for the scene-view with a 50% duty cycle square wave, as shown in FIG. 7E.

Figure 8:
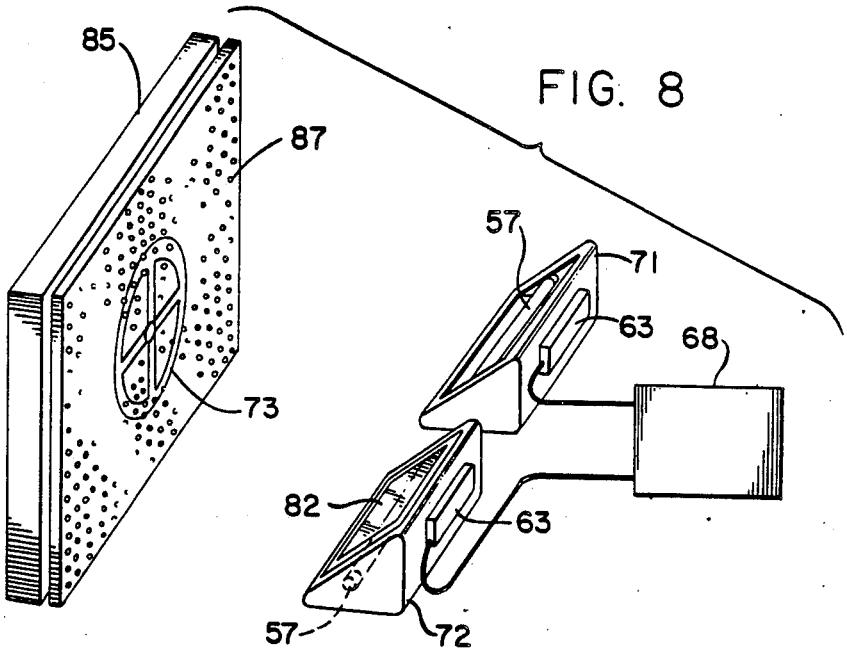
FIG. 8 is a side perspective view of a second embodiment of the invention employing both a long-wave and a short-wave ultraviolet lamp.

In those applications where it is desired to illuminate the animation scene panel from just one side, the embodiment shown in FIG. 8 may be utilized. In the embodiment shown in FIG. 8, one of the two ultraviolet illuminators used to illuminate the fluorescent scene-views to be animated is a long-wave "black light" as described above in the first embodiment. While either of the two ultraviolet illuminators 71 and 72 may be a long-wave unit, for this description it is assumed that illuminator 71 is the long-wave unit. Illuminator 72 in FIG. 8 is a short-wave ultraviolet illumination source comprising a tubular low-pressure mercury vapor lamp 77 and filter 82. Unlike the long-wave ultraviolet source 71, short-wave lamp 77 is constructed with a tube made of fused silica or quartz which is highly transmissive to the 2537 Å, short-wave ultra-violet emission caused by electrical discharge through the mercury vapor inside the lamp. In contrast, the tubes for long-wave ultraviolet lamps are made of ordinary glass, which is almost totally opaque to the 2537 Å radiation. Short-wave ultraviolet lamps of the type described are available from a number of manufacturers and are commonly referred to as germicidal lamps, that name owing to the fact the 2537 Å radiation emitted by the lamp is highly effective in killing bacteria.

As shown in FIG. 8, a filter 82 is placed over short-wave lamp 77. The purpose of the filter is to remove by absorption the visible mercury emission lines emanating from the lamp 77, while transmitting the 2537 Å radiation. Such filters are readily available from a number of manufacturers. Since filter material transmissive to short-wave ultraviolet is substantially more expensive and frangible than long-wave filter glass, short-wave ultraviolet lamps with integral filters in the lamp tube are not available, necessitating the use of an external filter as shown in FIG. 8.

Figure 9:
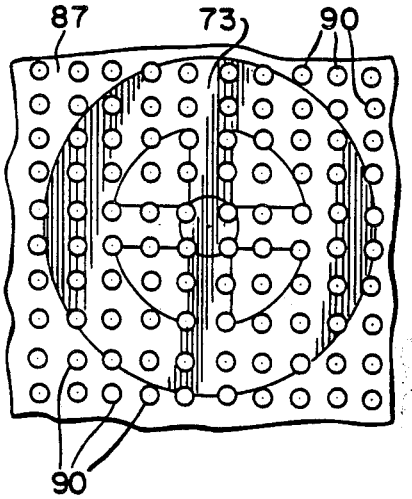
FIG. 9 is a fragmentary rear elevation view of the apparatus of FIG. 8 showing a scene-view of an exemplary animation subject.

In the embodiment shown in FIG. 8, long-wave ultraviolet illuminator 71 and short-wave ultraviolet illuminator 72 are used to alternately illuminate scene-views 73 and 74 respectively. The scene-views are rendered in such a way that scene-view 73 fluoresces only when excited by longwave ultraviolet radiation, and scene-view 74 fluoresces only when excited by short-wave ultraviolet radiation. To accomplish this wave-length selective fluorescence, the scene view which is to respond only to long-wave ultraviolet radiation is applied to the back of perforated sheet 87 as shown in FIG. 9. The size, shape and spacing of the perforations conform to requirements discussed above in connection with enabling the use of solid scene-views in the basic embodiment. Sheet 87 is made from material that is transmissive to visible light and long-wave ultraviolet radiation ("black light"), but opaque to short-wave ultraviolet radiation. Since most plastics and glasses are virtually opaque to short-wave ultra-violet radiation, there are a wide variety of materials that sheet 87 may be composed of. For example, vinyl or acetate sheets of the type described above are suitable for this application. Since sheet 87 is opaque to short-wave ultraviolet radiation and transparent to long-wave ultraviolet radiation and visible radiation, a scene painted on the rear side of sheet 87 with paint fluorescent to long-wave ultra-violet radiation will appear illuminated only when long-wave ultraviolet illuminator 71 is energized.

As shown in FIG. 9, scene 73 painted on the back side of sheet 87, i.e., on the side opposite the ultraviolet illuminators, shows a view of a wheel and axle end in which the pairs of spokes are oriented in horizontal and vertical directions, respectively. Thus, when long-wave ultraviolet illuminator 71 is energized, an observer will see that scene view.

Figure 10:
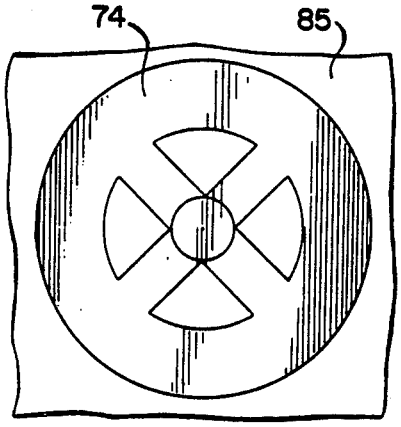
FIG. 10 is a fragmentary front elevation view of the apparatus of FIG. 8 in which the exemplary animation subject appears in a different position than the scene-view shown in FIG. 9.

As shown in FIG. 10, scene-view 74 showing the wheel in a position rotated 45 degrees from the position in scene-view 73 is painted on panel 85. Alternatively and preferably, scene-view 83 can be painted on a sheet of plastic similar to sheet 87, but without perforations, and attached to panel 85 by any suitable means.

Scene-view 74 is applied with paints sensitive to short-wave ultraviolet radiation but not to long-wave ultraviolet radiation. Such paints can be made from phospors with quantum fluorescent excitation energy thresholds greater than the energy of photons in the black-light region of the ultraviolet spectrum, but smaller than the energy of photons having the wave length of the low-pressure mercury vapor emission peak (2537 Å). A large number of inorganic phosphors satisfy this requirement of being fluorescent when excited by short-wave ultraviolet radiation, but unresponsive to the lower energy photons characteristic of the long-wave or black-light region of the ultraviolet spectrum For example, the following phosphors used for their cathodoluminescent properties in cathode ray tubes are fluorescent under short-wave ultraviolet excitation, but not long-wave.

| JEDEC Designation | Composition | Fluorescent Colors |
|---|---|---|
| P-22 | $Y_2O_3$:Eu | RED |
| P-1 | $Zn_2SiO_4$:Mn | GREEN |
| P-5 | $CaWO_4$ | BLUE |

Thus, when short-wave ultraviolet illuminator 72 is energized, short-wave ultra-violet radiation passes through perforation holes 90 in sheet 87 and falls on rear scene-view 74, causing scene-view 74 to fluoresce. Since sheet 87 is opaque to short-wave ultraviolet radiation, that radiation can not induce fluorescence in scene-view 73 painted on the back side of sheet 87.

When long-wave ultraviolet illuminator 71 is energized, long-wave ultraviolet radiation from lamp 57 is transmitted through sheet 87, causing scene-view 73 to fluoresce. However, the long-wave ultraviolet radiation falling on alternate scene-view 74 has insufficient quantum energy to excite the short-wave phosphors with which scene 74 is depicted, so scene 74 remains dark while long-wave lamp 57 is energized. Alternate energization of illuminators 71 and 72 according to the time sequence shown in Figure 7 produces the visible impression of a wheel rotating back and forth between the two positions depicted in scene-views 74 and 73.

The embodiment shown in FIG. 8 is well-suited to store window sign and display applications. For those applications, illuminators 71 and 72 can be placed inside the store, facing window 85. The short-wave fluorescent scene-view can be applied to a transparent plastic sheet which can be placed in direct contact with window 85. The long-wave fluorescent scene-view can be applied on the back side of perforated sheet 87, which in turn can be placed in direct contact with the sheet bearing the short-wave fluorescent scene-view. Ordinary visibly transparent glass or plastic sheets or panels may be used to prevent short-wave ultraviolet energy radiating from illuminator 82 from inadvertently falling on the eyes of an observer inside the store. Window 85 itself will prevent any potentially harmful short-wave radiation from reaching observers outside the store.

Figure 11:
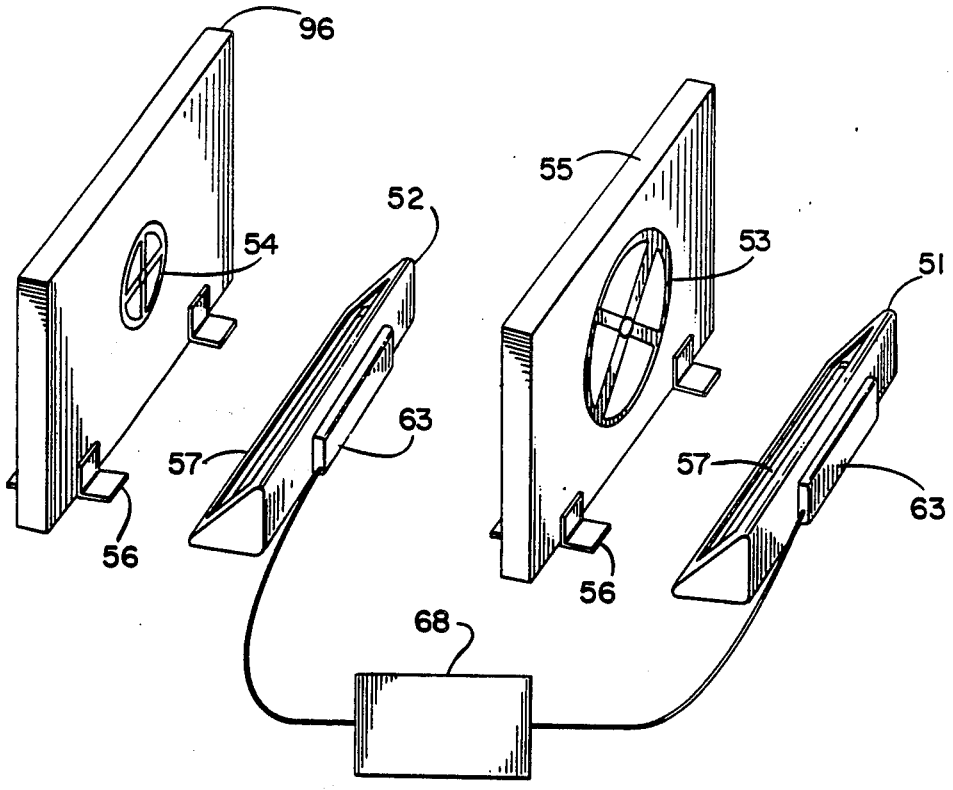
FIG. 11 is a side perspective view of a third embodiment of the invention in which alternate scene-views are attached to parallel panels spaced apart from one another.

In applications where it is desired to produce the sensation of motion towards or away from an observer, in place of or in addition to motion in a plane perpendicular to the observers line of sight, a third embodiment of the invention, shown in FIG. 11, may be used. In this embodiment, long-wave ultraviolet illuminator 51 is used to illuminate scene-view 53 on the front of visibly-transparent, ultraviolet-absorbing panel 55, exactly as has been described for the basic embodiment shown in FIG. 1. In contrast with the basic embodiment of FIG. 1, however, scene-view 54 is placed on the front of a second panel 96 placed some distance from panel 55. Thus, alternately energizing illuminators 51 and 52 according to the timing sequence shown in FIG. 7 causes the plane in which a fluorescent scene-view 53 or 54 occurs to move back and forth parallel to on observer's line of sight. For example, the wheel example shown in FIGS. 4 and 5 would appear not only to rotate but move back and forth, away from, and towards an observer. Rear panel 96 can be transparent if it is desired to make the animation scene viewable from the left as well as the right, but need not be opaque to ultraviolet radiation.

Figure 12:
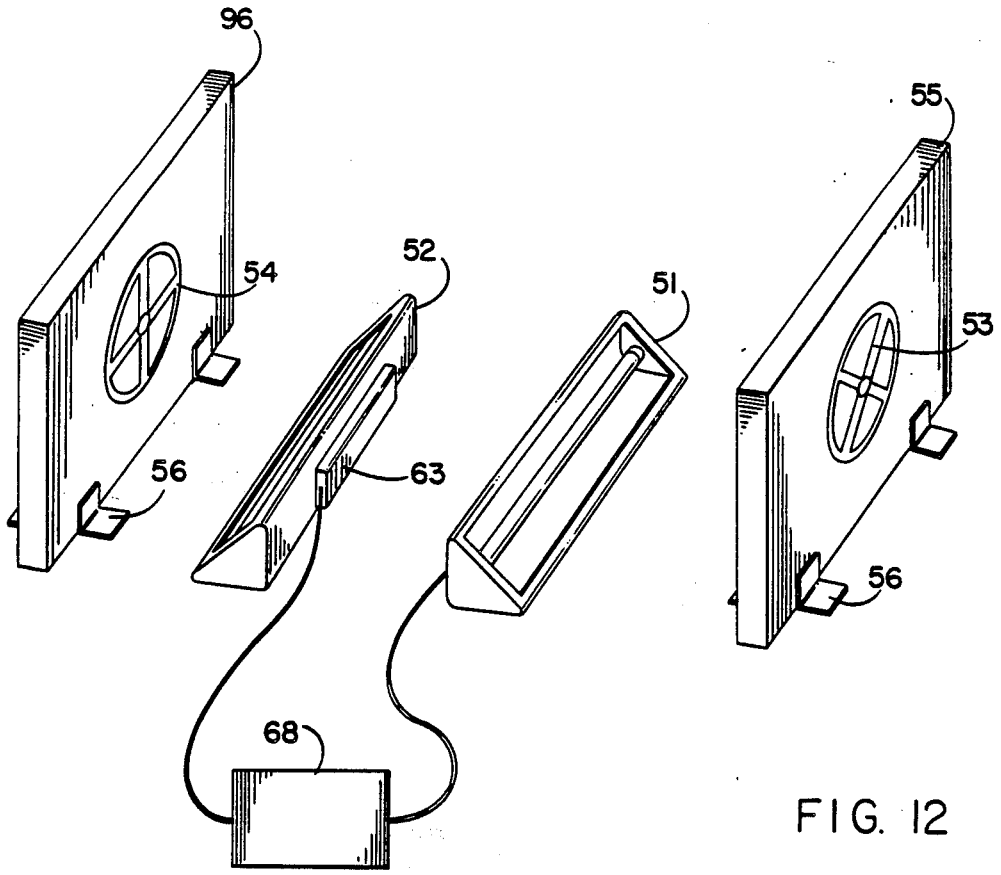
FIG. 12 is a side perspective view of a fourth embodiment of the invention which eliminates the requirement for a display panel to be opaque to ultraviolet radiation by pointing two lamps in opposite directions.

In a fourth embodiment of the invention shown in FIG. 12, illuminators 51 and 52 are placed back to back, resulting in their ultraviolet illumination fields being directed in opposite directions. In this configuration, the non-selected view is geometrically shielded from undesired illumination by the lamp illuminating the selected view. Therefore, neither panel 55 nor panel 96 is required to be opaque to ultraviolet radiation in the configuration shown in FIG. 12.

Figure 13:
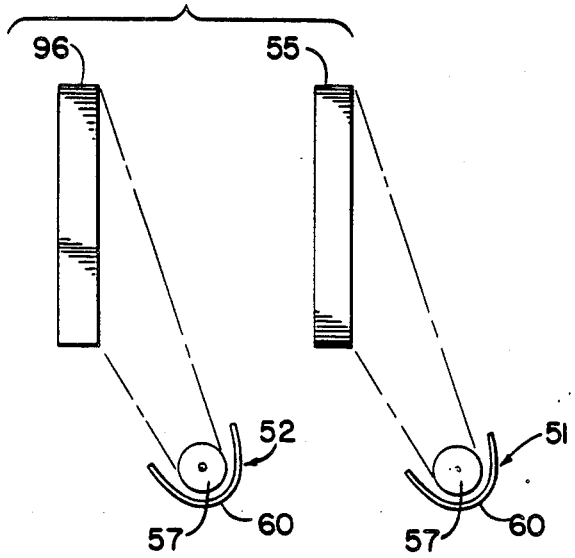
FIG. 13 is a side perspective view of a fifth embodiment of the invention which eliminates the requirement for a display panel to be opaque to ultraviolet radiation by displacing two lamps further upward or downward from the longitudinal center line jointing the two panels.

FIG. 13 illustrates a fifth embodiment of the invention. In that embodiment, rear illuminator 51 is placed below or above display panels 55 and 96. As shown in FIG. 13, the illumination field of rear illuminator 51 is constrained by the shadowing effect of the lower edge of reflector 60 to avoid illuminating front panel 96. Therefore, neither panel 55 nor panel 96 is required to be opaque to ultraviolet radiation in the configuration shown in Figure 13.

Figure 14:
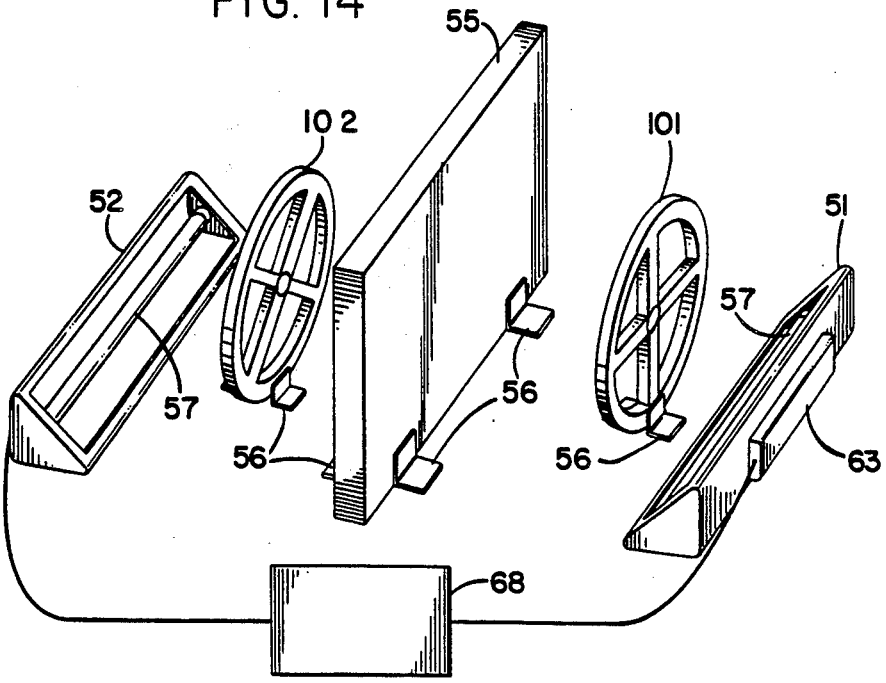
FIG. 14 is a side perspective view of a sixth embodiment of the invention using three-dimensional objects rather than planar scene-views.

FIG. 14 shows a sixth embodiment of the invention. In that embodiment, a three dimensional object 101 is placed in front of visibly-transparent ultraviolet-absorbing panel 55. The object 101 is made of visibly fluorescent material or painted with fluorescent paint. A second three-dimensional object 102 is placed behind panel 55. The second object is also made to be fluorescent by constructing it of fluorescent material or painting it with fluorescent paint. Alternately illuminating objects 101 and 102 with illuminators 51 and 52, respectively, causes the visual impression of the object moving back and forth between the portions occupied by the two objects. Also, the object appears to move from the aspect shown by the one object to the aspect shown by the second.

Figure 15:
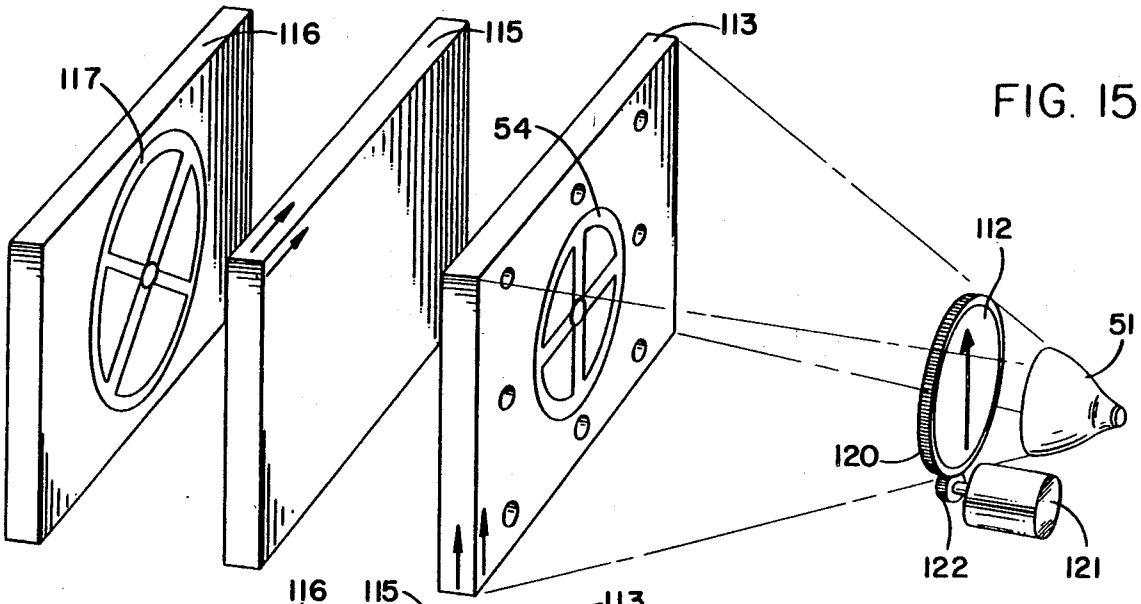
FIG. 15 is an exploded side perspective view of a seventh embodiment of the invention using a rotating polarizer in front of an ultraviolet lamp.
Figure 16:
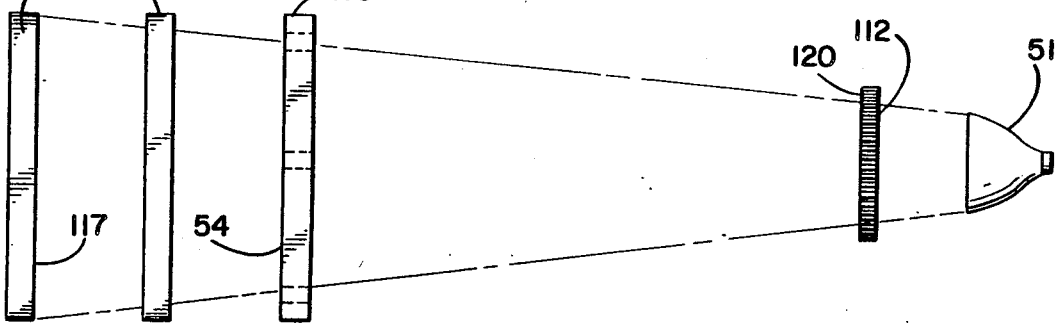
FIG. 16 is an exploded side elevation view of the apparatus shown in FIG. 15.

FIGS. 15 and 16 show a seventh embodiment of the invention. In that embodiment, a single ultraviolet illuminator can be used to produce animation effects. As shown in FIG. 15, long-wave ultraviolet radiation emitted by ultraviolet illuminator 51 is plane polarized by polarizer 112 and falls on perforated polarizing sheet 113. Polarizer 112 is mounted in annular ring gear 120 which is rotatably driven by motor 121 through gear 112.

One scene-view 54 is painted on the back side of perforated polarizing sheet 113 with ultraviolet fluorescent paint. Behind sheet 113 is a second polarizing sheet 115 having its axis of polarization perpendicular to the axis of polarization of perforated polarizing sheet 113, as indicated by the arrows on sheets 113 and 115 in FIG. 15. Behind polarizing sheet 115 is a back panel 116 which may be either transparent or opaque, depending on whether or not it is desired to view the animated display from the rear as well as from the front. An alternate scene-view 117 is painted on back panel 116 with ultraviolet fluorescent paint.

When rotatable polarizer 112 is oriented so that its polarization axis is parallel to the polarization axis of perforated sheet polarizer 113, only scene-view 54 fluoresces, since the perpendicular orientation of the polarization axis of polarizer 125 blocks transmission of orthogonally polarized light. Similarly, when polarizer 112 is rotated so that its polarization axis is parallel to the polarization axis of back sheet polarizer 115, the polarization axis of ultraviolet radiation incident upon front perforated sheet polarizer is perpendicular to the polarization axis of sheet 113. Thus, for this orientation, only scene-view 117 is illuminated by ultraviolet radiation passing through perforation holes in sheet 113 and subsequently through polarizer 115 to scene-view 117 on panel 116. When polarizer 112 is rotated at a few revolutions per second, the object depicted by scene-views 54 and 117 appears to move between the respective positions of the two views.

Figure 17:
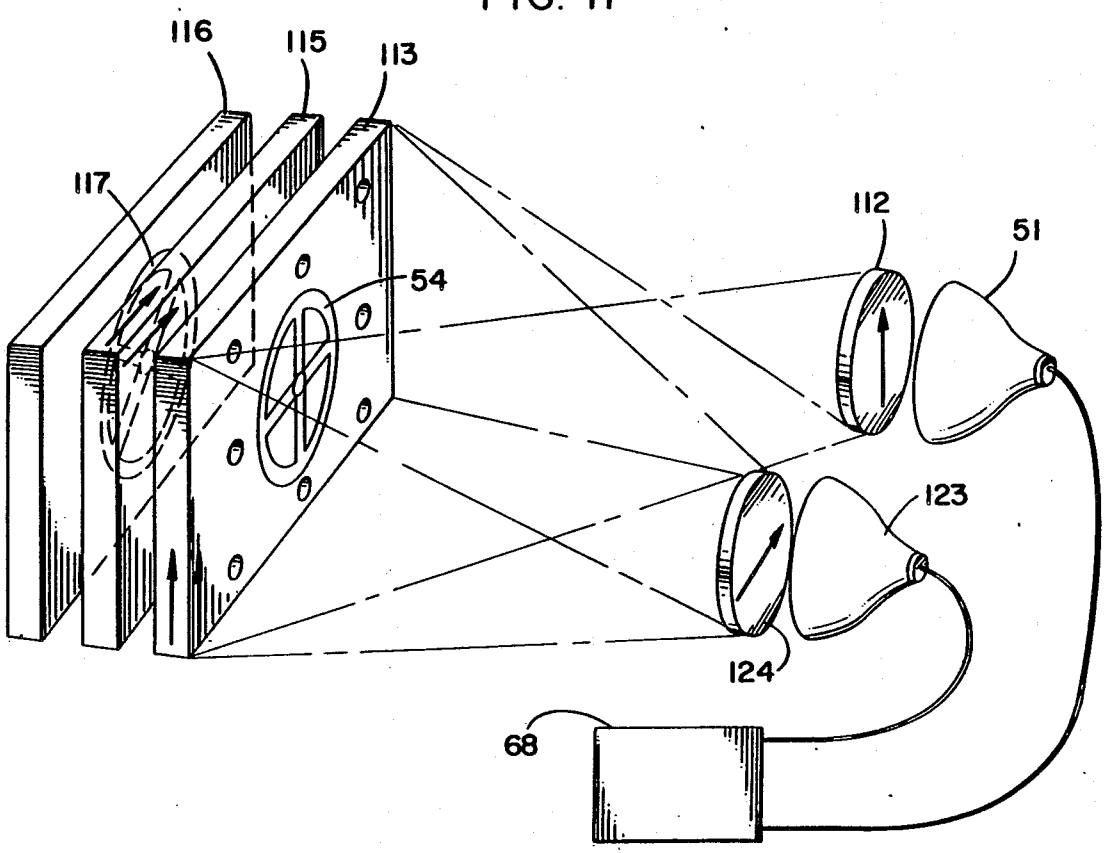
FIG. 17 is an exploded side perspective view of an eighth embodiment of the invention employing two ultraviolet lamps fitted with orthogonal, fixed polarizers.

FIG. 17 shows an eighth embodiment of the invention. In that embodiment, which is a variation of the embodiment shown in FIGS. 15 and 16, two ultraviolet illuminators 51 and 123 are used to alternately illuminate scene views 54 and 117. Ultraviolet radiation emitted by illuminator 51 is vertically polarized by plane polarizer 112 and is effective in illuminating scene-view 54 but not scene-view 117. Similarly, ultraviolet radiation emitted by illuminator 123 is horizontally polarized by plane polarizer 124 and is effective in illuminating scene-view 117 but not scene-view 54. When illuminators 51 and 123 are alternately energized in accordance with the timing sequence shown in FIG. 7, the object depicted by the two sceneviews appears to move between the respective positions of the two views. Illuminator controller 68 performs the same function in this embodiment as has been described for the basic embodiment.

Figure 18:
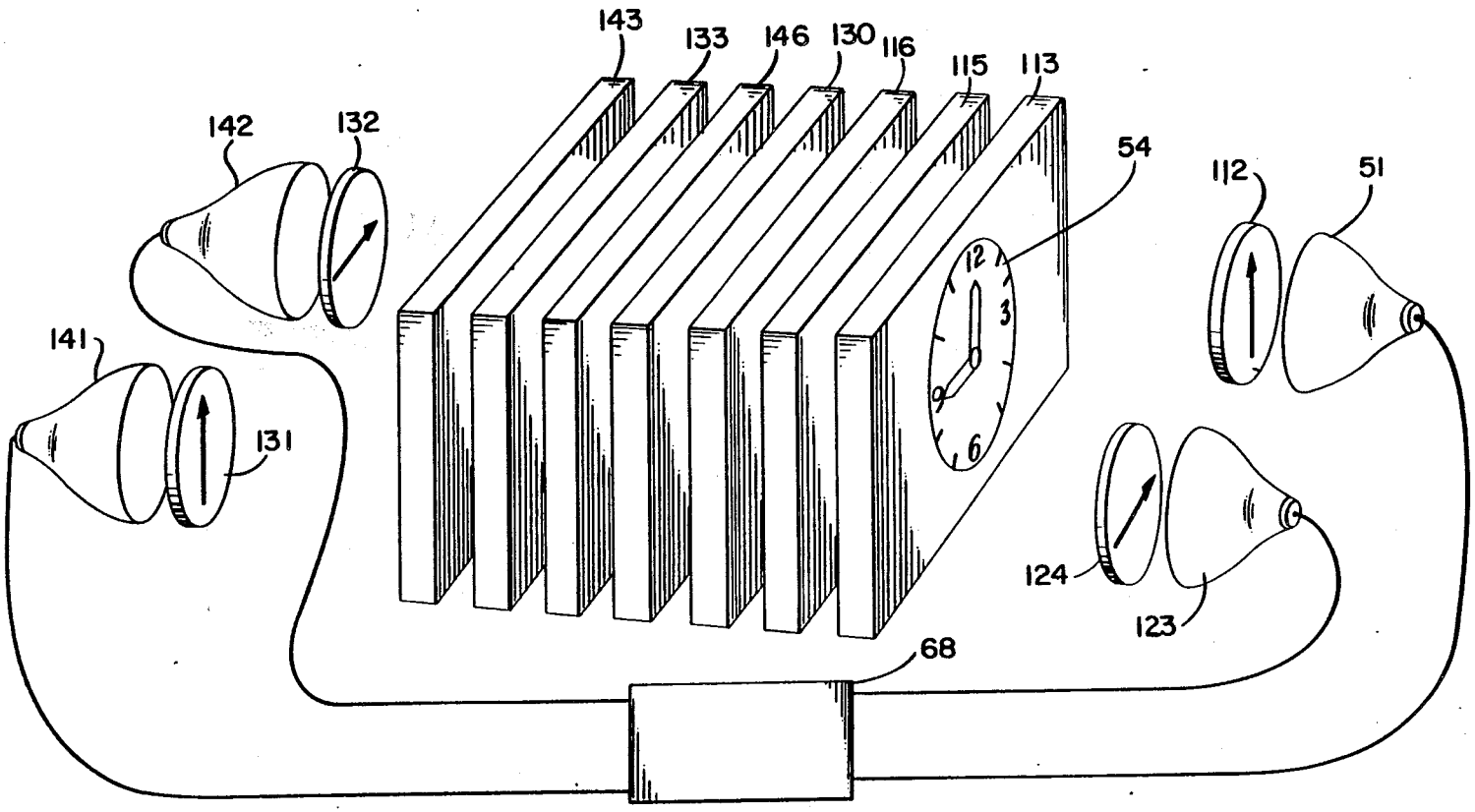
FIG. 18, is a side perspective view of a ninth embodiment of the invention using two systems as shown in FIG. 17 to produce four scene-views.
Figure 19:
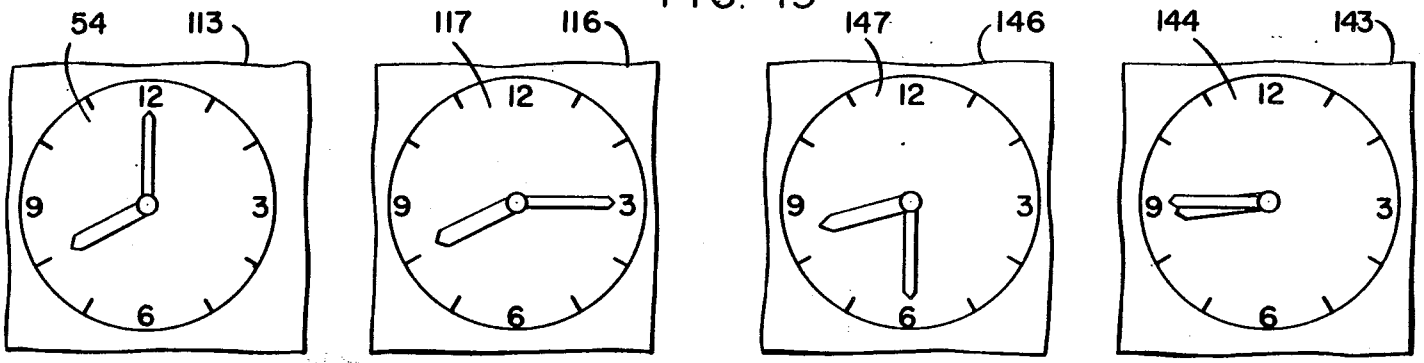
FIG. 19 is an elevation view of the four scene views of the exemplary animation subject shown in FIG. 18.
Figure 20:
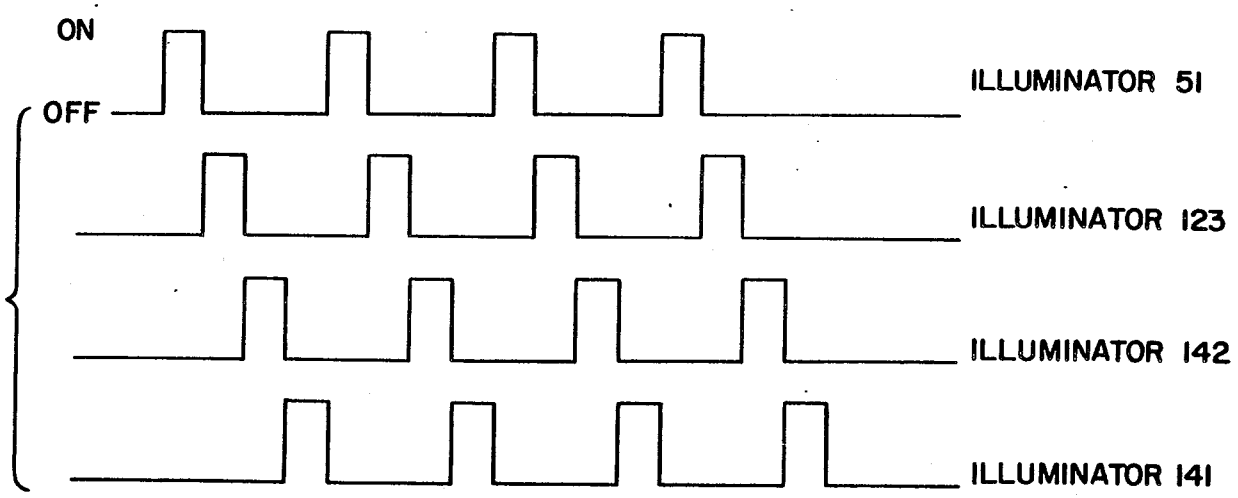
FIG. 20 is a timing sequence diagram for the energization of the lamps shown in FIG. 18.

FIG. 18 shows a ninth embodiment of the invention. In that embodiment, which is a variation of the eighth embodiment, two ultraviolet illumination systems of the type shown in FIG. 17 are placed on either side of panel 130. Illuminators 51 and 123 illuminate display scene-views 54 and 117 on panels 113 and 116, respectively, while analogous illuminators 141 and 142 illuminate display scene-views 114 and 147 on panels 143 and 146, respectively. FIG. 19 shows the sequence of four scene-views 54, 117, 144, and 147. When illuminators 51, 123, 141 and 142 illuminate the respective fluorescent scene-views 54, 117, 144 and 147 according to the timing sequence shown in FIG. 20, the object depcited in the sequence of four scene-views appears to move sequentially between the views. Ultraviolet-absorbing panel 130 is placed between panels 116 and 146 to prevent right-and left-hand illumination systems from illuminating left-and right-hand scene-view pairs, respectively.

Figure 21:
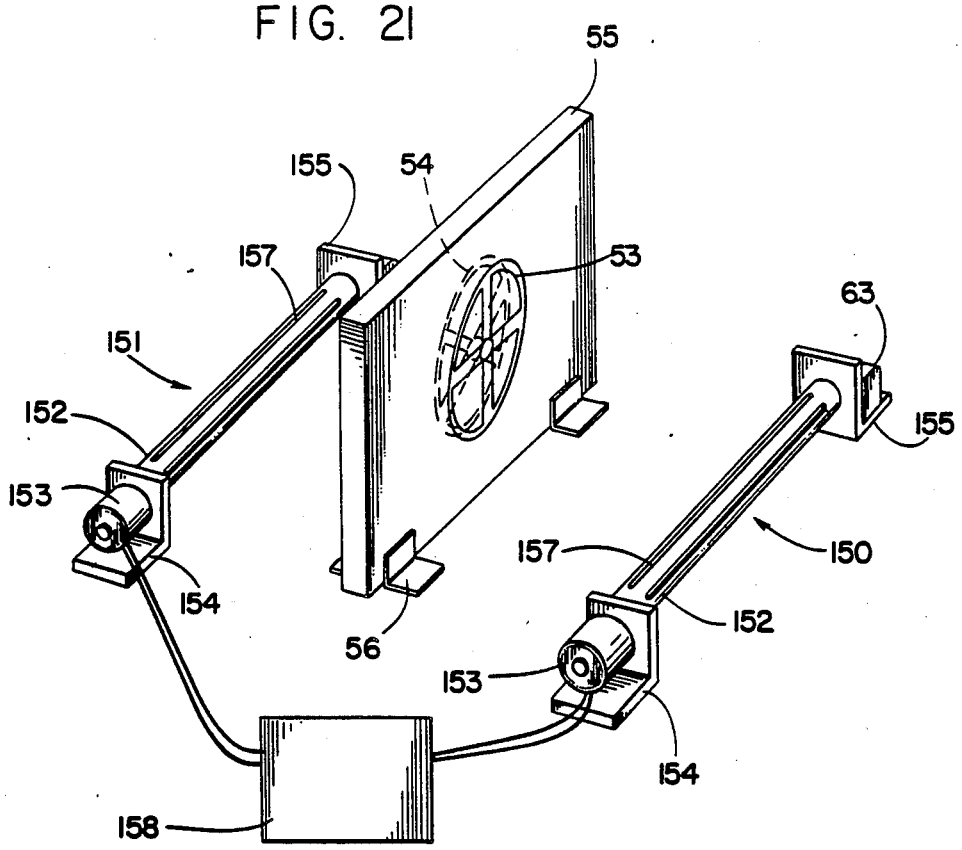
FIG. 21 is a side perspective view of a tenth embodiment of the invention employing rotating lamp shutters.
Figure 23:
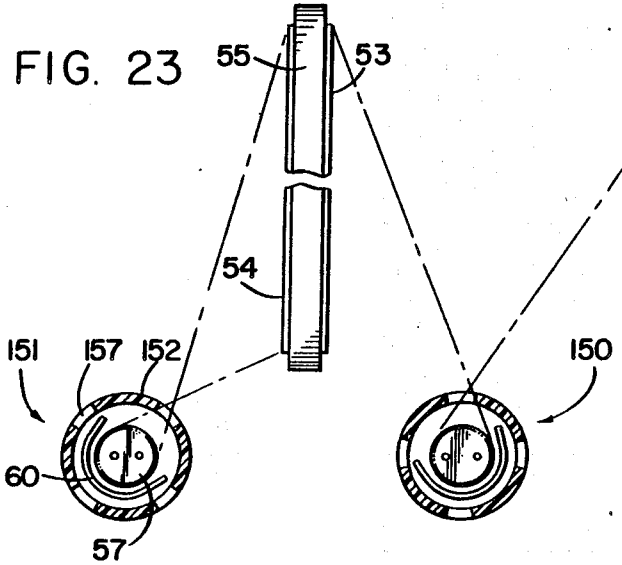
FIG. 23 is a sectional and diagramatic side elevation view of the apparatus of FIG. 21 showing the phasing of the shutters.
Figure 22:
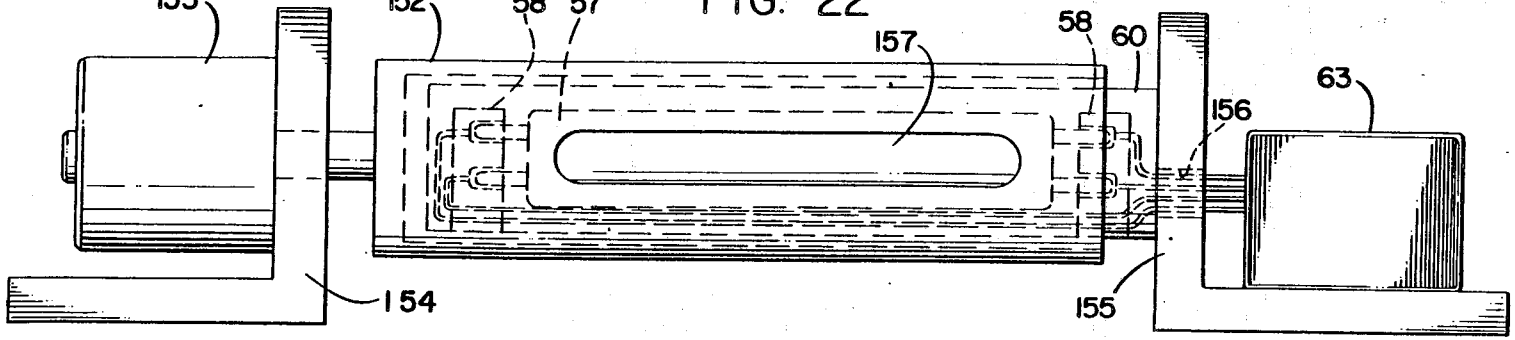
FIG. 22 is a side elevation view of one of the illuminators shown in FIG. 21.

In a tenth emobidment shown in FIGS. 21 and 22, ultraviolet lamps in an arrangement similar to the embodiment shown in FIG. 1 are made to alternately illuminate alternate scene-views by electromechanical means rather than by turning the lamps off and on. As shown in FIGS. 21, 22 and 23, ultraviolet illuminators 150 and 151 have slotted cylindrical tubes 152 mounted coaxially over ultraviolet lamps 57, which tubes are rotatably driven by motors 153. Motors 153 are supported by end brackets 154. Lamps 57 are supported by lamp sockets 58 fastened to parabolic reflectors 60. Reflector 60 are supported by end brackets 155. Holes 156 through the vertical legs of brackets 155 allow electrical wires to connect lamp sockets 58 to ballast modules 63. Motors 153 are driven by controller 158 in a phase-displaced sequence as shown in FIG. 23 such that one scene-view is illuminated while the illumination of the alternate scene-view is blocked by an an opaque portion of slotted cylinder 152 in the alternate illuminator. Preferably, stepper motors are used in this application, since the speed and relative rotation phase of stepper motors is easily controllable by methods well known to those skilled in the art. Alternatively, synchronous motors or d.c. servo motors driven in a closed position servo loop may be used.

Figure 24:
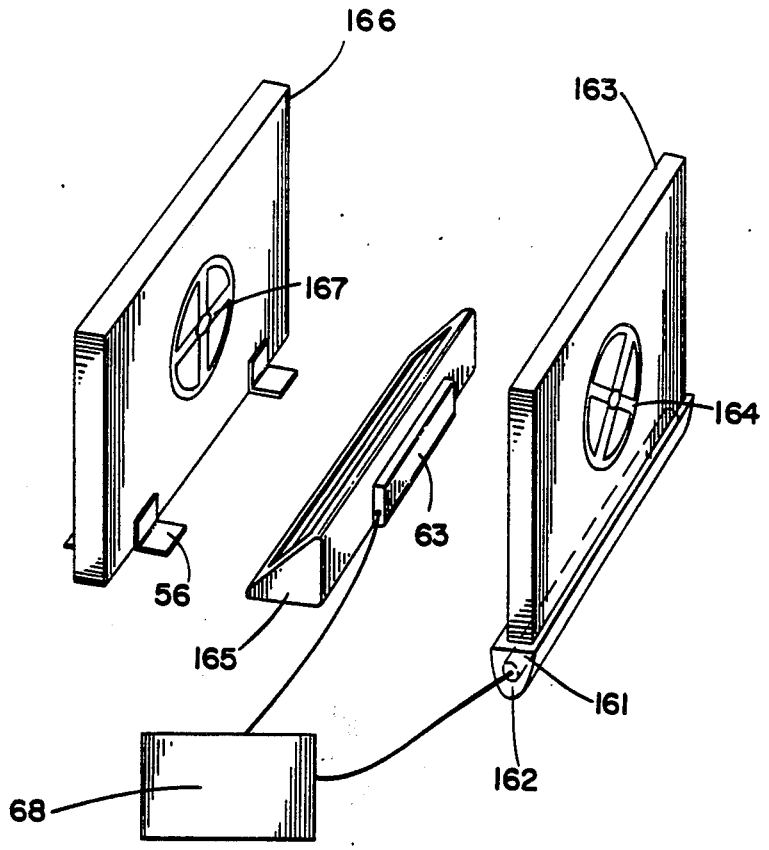
FIG. 24 is a side perspective view of an eleventh embodiment of the invention using one edge-illuminated panel and one flood-illuminated panel.

FIG. 24 shows an eleventh embodiment of the invention. In that embodiment, ultraviolet radiation from lamp 161 is focused by elliptical reflector 162 onto the edge of ultraviolet transmitting panel 163. Panel 163 may be made of ultraviolet transmitting acrylic, or ordinary glass. For incident angles of internal illumination of the flat surfaces of the panel greater than the critical angle for the material (approximately 42 degrees for glass or acrylic having an index of refraction of 1.5), the illumination rays within the panel will be totally internally reflected from the interior surfaces of the panel, "piping" the ultraviolet light from the bottom of the panel to the top.

However, the total internal reflection of ultraviolet radiation in panel 163 may be frustrated by painting a scene 164 on either surface of the panel. Frustrating the total internal reflection permits a portion of the ultraviolet radiation reflecting back and forth between the flat surfaces of the panel to be transmitted through the surface of the panel to the scene-view. If the scene-view is painted on the panel surface using fluorescent paint, illuminating the edge of the panel with ultraviolet light will cause the scene to fluoresce brightly. Since in this embodiment only scenes on the panel surface are illuminated when lamp 161 is energized, an unfiltered black light may be used for lamp 161 in those applications where visible as well as ultraviolet illumination of the scene-views is desirable.

The coupling efficiency of light piped within the interior of the panel to scene-views painted on the panel can be increased by roughening the surface of the panel before applying the painted image. However, since roughening the surface causes some piped radiation to leak out even in the absence of a painted image, roughening the surface reduces the efficiency of light transmission from the bottom to the top of the panel.

As shown in FIG. 24, a second ultraviolet illuminator 165 is used to flood-illuminate panel 116 constructed of a visibily transparent material. Thus, when lamps 161 and illuminator 165 are alternately energized, scene-views 164 and 167 alternately appear. With illuminator 165 positioned between panels 163 and 166 so that radiation from illuminator 165 does not fall on panel 163, panel 166 need not be opaque to ultraviolet radiation.

Figure 25:
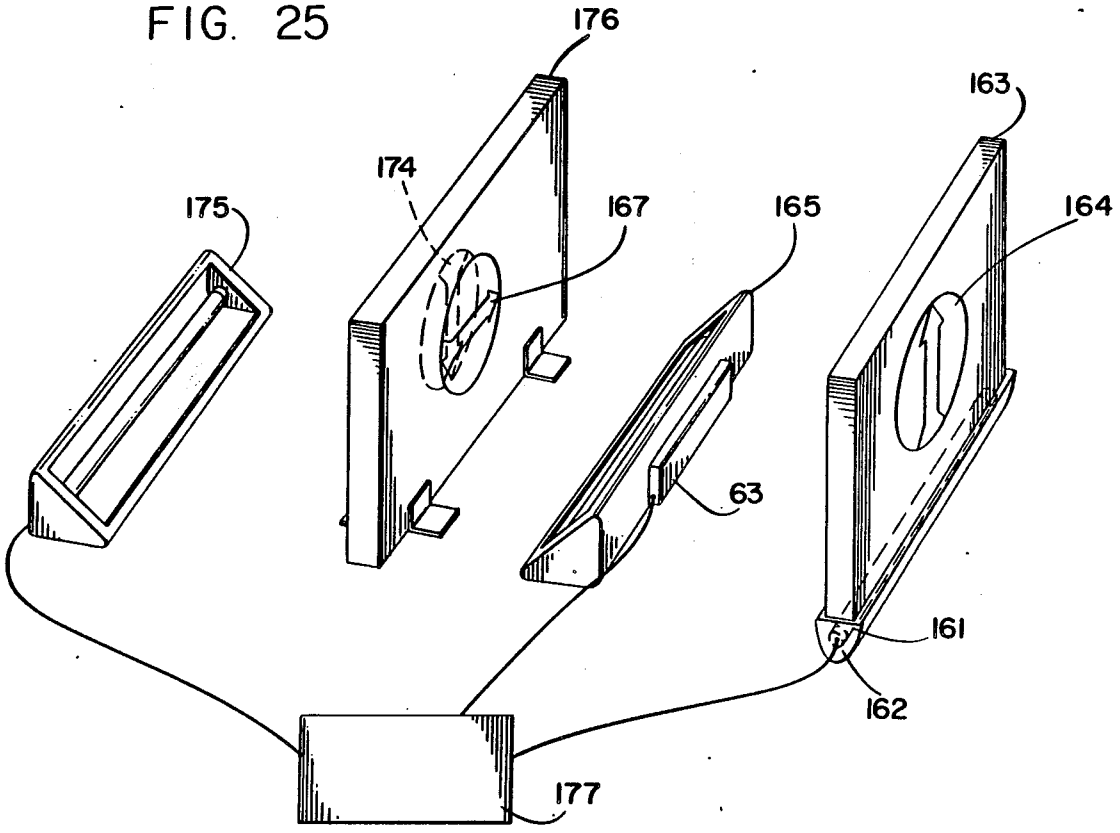
FIG. 25 is a side elevation view of a twelfth embodiment of the invention employing one edge-illuminated panel and two flood-illuminated panels.
Figure 27:
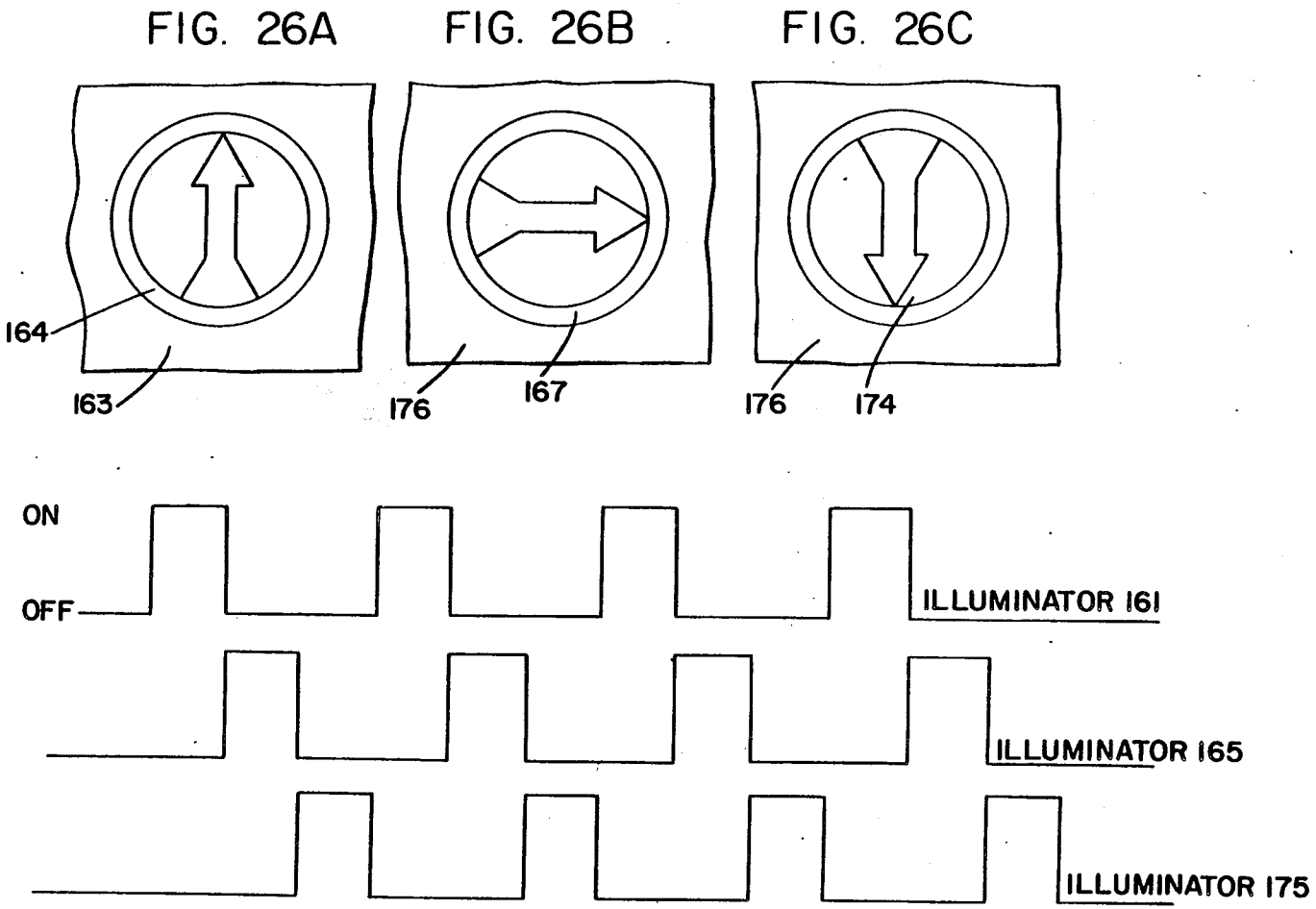
FIG. 27 is a timing sequency diagram for the energization of the lamps shown in FIG. 24.

FIG. 25 shows a twelfth embodiment of the invention. That embodiment adds the capability for displaying a third scene-view to the eleventh embodiment shown in Figure 24. As shown in FIG. 25, a third ultraviolet illuminator 175 is used to flood-illuminate a third scene-view 174 painted on the rear side of second ultraviolet absorbing, visibly transparent panel 176. Three exemplary scene-views depicted on panels 163, 165 and 175 are shown in Figure 26. FIG. 27 shows a typical timing sequence diagram for the three lamps shown in FIG. 25. Lamp control circuit 177 produces a three-phase sequence of mutually exclusive illuminator command signals with waveforms as shown in FIG. 27.

Figure 28:
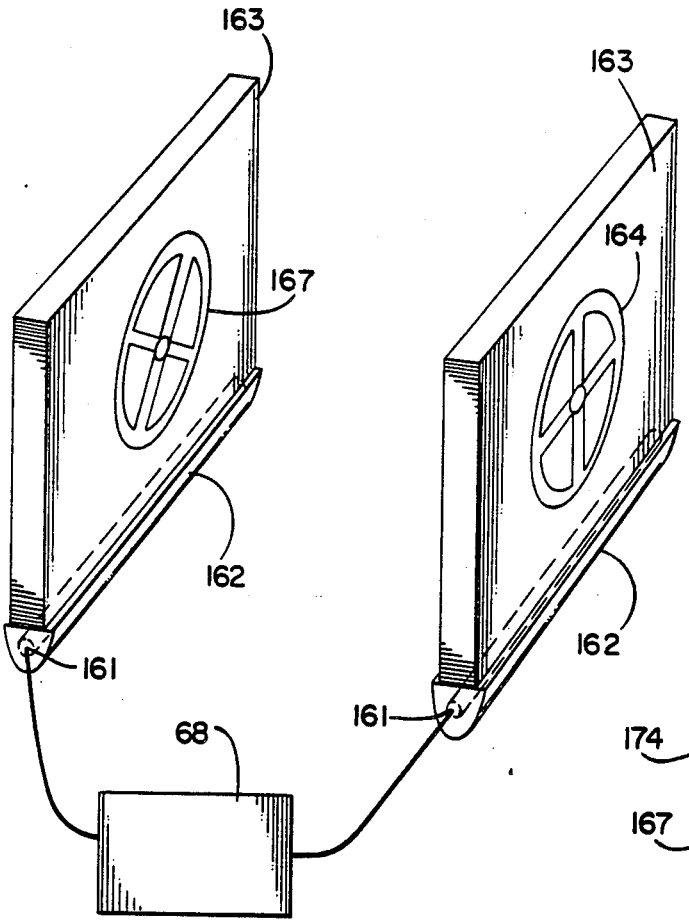
FIG. 28 is a side perspective view of a thirteenth embodiment of the invention using a plurality of panels edge-illuminated by a plurality of lamps.

FIG. 28 illustrates a thirteenth embodiment of the invention. In that embodiment, a plurality of lamps 161 and elliptical reflectors 162 are used to edge illuminate a corresponding number of ultraviolet transmitting panels 163 with flourescent scene-views 164 painted on either or both sides of the panel. Lamp control circuit 68 controls the successive illumination of the respective panels and scenes.

Figure 29:
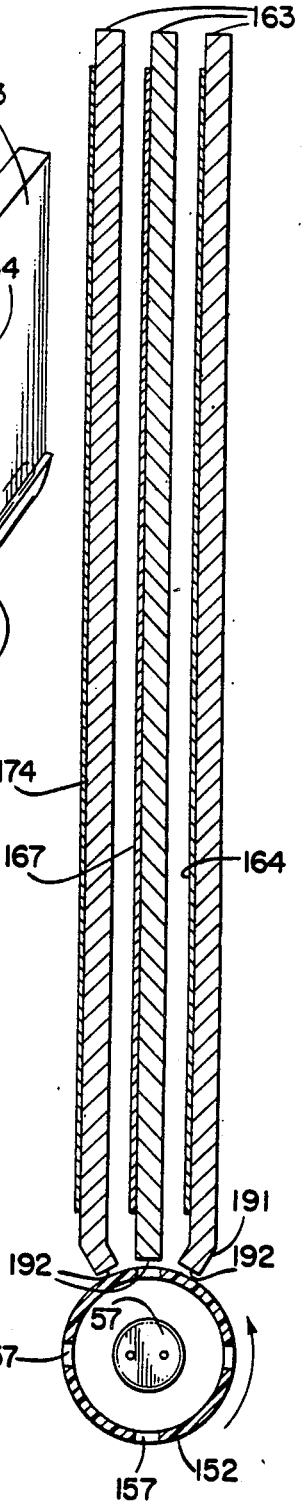
FIG. 29 is a side perspective view of a fourteenth embodiment of the invention using a plurality of panels edge-illuminated by a single lamp enclosed by a rotating lamp shutter.

FIG. 29 illustrates a fourteenth embodiment of the invention. That embodiment employs a single ultraviolet illuminator. The illuminator comprises a continuously energized, self-filtering, long-wave ultraviolet lamp and a motor driven tube having longitudinal aperture slots and mounted coaxially over the ultraviolet lamp. The illuminator is of the type shown in detail in FIGS. 21 and 22, and is used to sequentially illuminate the lower edge surfaces 192 of a plurality of ultraviolet-transmissive panels 163. As may be seen by referring to FIG. 29, rotating shutter tube 152 permits radiation from cylindrical ultraviolet lamp 57 to pass through aperture slots 157 in shutter tube 152 and fall on lower edge surfaces 192 of panels 163. To maximize the efficiency of transmission of ultraviolet radiation through lower edge surfaces 192, the lower ends 191 of panels 163 are bent so that lower edge surfaces 192 are nearly tangent to the outer diameter of shutter tube 152. This ensures that radiation passing through slots 157 in shutter tube 152 falls on lower edge surfaces 192 at nearly perpendicular angles of incidence, maximizing the transmission of ultraviolet radiation into slabs 163.

As has been described above for the eleventh embodiment of the invention, ultraviolet radiation entering panels 163 is conducted upward through the panels by total internal reflection. Frustrating the total internal reflection by painting fluorescent scene-views on the surfaces of the panels causes the scene-views to fluoresce brightly. Therefore, rotating shutter tube 152 causes the sequential fluorescence of successive scene-views painted on the plurality of panels 163. For example, if each of the three scene-views shown in FIG. 26 is painted on a different panel 163, sequentially illuminating panels 163 will produce the visual sensation of an arrow initially pointing upward, rotating 90 degrees clockwise to a horizontal position, rotating 90 degrees clockwise to a downward pointing position, and 180 degrees clockwise to its original upright pointing position to complete the cycle.

Figure 30:
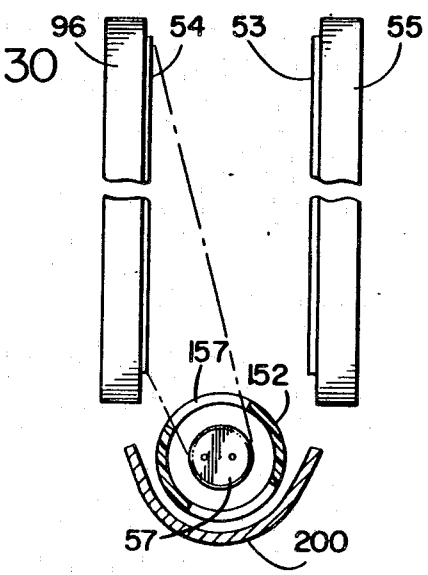
FIG. 30 is a side perspective view of a fifteenth embodiment of the invention using two panels illuminated by a single lamp enclosed by a rotating lamp shutter.

FIG. 30 shows a fifteenth embodiment of the invention. That embodiment employs a single illuminator as shown in FIG. 29 with two scene panels as shown in figures 11 and 12.

Referring now to FIG. 30, a slotted cylindrical shutter tube cylinder 152 is mounted coaxially over tubular ultraviolet lamp 57. Cylinder 152 is rotatably driven by motor 153. Rotation of cylinder 152 permits ultraviolet radiation from the lamp to pass through longitudinal aperture slots 157 and sequentially illuminate scene-view 53 on transparent panel 55 and scene-view 54 on transparent panel 96. Neither panel 55 nor panel 96 is required to opaque to ultraviolet radiation in the configuration shown in figure 30. A cylindrical reflector 200 having a semi-circular cross section is mounted coaxially underneath shutter tube 152 and lamp 157, to reflect radiation which would otherwise escape through a slot adjacent to the reflector back through an upper slot and onto a scene-view.

It will be appreciated that the present invention provides a simple and practical method for producing animation effects in signs and displays. It will also be appreciated that, although specific embodiments of the invention have been described in detail sufficient for purposes of illustration, various modifications may be made without departing from the spirit of the invention. For the sake of brevity all possible permutations and combinations of the inventive concepts contemplated by the invention have not been incorporated into the specification. For example, various colored visible illumination sources could be used with appropriately colored display scene-views to produce the selective appearance of scene-views. Accordingly, the invention is not to be limited except as by the appended claims.

What is claimed is:

1. A method for producing the visual sensation of apparent motion in signs and displays comprising:
   (a) depicting with material visibly fluorescent to ultraviolet radiation a first scene-view of a subject to be displayed,
   (b) depicting with a material visibly fluorescent to ultraviolet radiation at least one alternate scene-view of said subject,
   (c) illuminating said first scene-view with ultraviolet radiation while simultaneously blocking illumination of said alternate scene-view with ultraviolet radiation, and
   (d) sequentially illuminating said alternate scene-view with ultraviolet radiation while simultaneously blocking illumination of said first scene-view with ultraviolet radiation.

2. The method of claim 1 wherein said first and alternate scene-views are optically contacted wtih surfaces of first and alternate ultraviolet transmissive panels, respectively, and which panels are sequentially edge-illuminated with ultraviolet radiation.

3. The method of claim 1 wherein non-selected scene-views in an illumination sequence are shielded from ultraviolet radiation falling on a selected scene-view in said illumination sequence by placing the non-selected scene-views outside of the geometric radiation pattern of ultraviolet radiation used to illuminate a selected scene-view.

4. The method of claim 1 wherein said first scene-view is responsive to a first type of ultraviolet radiation and each said alternate scene-view is responsive to an alternate type of ultraviolet radiation.

5. The method of claim 4 wherein said first type of ultraviolet radiation has a wavelength range of approximately 3000 Å to 4000 Å and said alternate type of ultraviolet radiation occupies a shorter wavelength region of the ultraviolet spectrum centered about the 2537 Å emission peak for mercury vapor.

6. The method of claim 4 wherein said first type of ultraviolet radiation has one polarization sense, and said alternate type of ultraviolet radiation has a polarization sense orthogonal to the polarization sense of said first type of ultraviolet radiation.

7. An apparatus for producing the visual sensation of apparent motion comprising:
   (a) at least one source of ultraviolet radiation,
   (b) a first object visibly fluorescent to said ultraviolet radiation,
   (c) at least one alternate object visibly fluorescent to ultraviolet radiation, and
   (d) means for selectably directing said ultraviolet radiation onto said first object while simultaneously blocking illumination of said alternate object with ultraviolet radiation, and
   (e) means for selectably directing said ultraviolet radiation onto said alternate object while simultaneously blocking illumination of said first object with ultraviolet radiation.

8. The apparatus of claim 7 wherein said means for sequentially directing ultraviolet radiation onto said first and alternate visibly fluorescent objects comprises:

(a) a plurality of visibly-transparent, ultraviolet-transmissive panels, one each in optical contact with a separate fluorescent object, and (b) a source of ultraviolet radiation adapted to coupling ultraviolet radiation into the interior of a selected panel by total internal reflection and through a panel surface by frustrated total internal reflection to said visibly fluorescent object in optical contact with said panel surface.

9. The apparatus of claim 7 further comprising means for shielding ultraviolet radiation directed towards a selected fluorescent object from falling upon a non-selected fluorescent object, said means comprising positioning non-selected objects outside of the geometric radiation pattern of said source of ultraviolet radiation used to illuminate a selected object.

10. An apparatus for producing the visual sensation of apparent motion comprising:

(a) at least one source of a first type of ultraviolet radiation, (b) at least one first type object visibly fluorescent to said first type of ultraviolet radiation, (c) at least one source of a second type of ultraviolet radiation, (d) at least one alternate object visibly fluorescent to said second type of ultraviolet radiation, and (e) means for selectably directing radiation from said first and second types of ultraviolet radiation sources to said first and second types of visibly fluorescent objects, respectively, thereby producing a visual sensation of apparent motion between said first and alternate objects.

11. The apparatus of claim 10 wherein said first type of visibly-fluorescent object is responsive to ultraviolet energy in a wavelength range of approximately 3000 Å to 4000 Å, and said alternate visibly fluorescent object is responsive to ultraviolet energy in a shorter wavelength region of the ultraviolet spectrum centered about the 2537 Å emission peak for mercury vapor.

12. The apparatus of claim 11 wherein objects fluorescent to ultraviolet radiation in the approximate wavelength range of 3000 Å to 4000 Å are rendered non-fluorescent to shorter wavelength ultraviolet radiation centered about the 2537 Å emission peak for mercury vapor by placing material transmissive to radiant energy in the 3000 Å to 4000 Å range, but opaque to shorter wavelengths, in overlying relationship to said objects.

13. The apparatus of claim 11 wherein said first type of visibly fluorescent object is further defined as a planar image which is a graphical representation of a subject to be displayed, said planar image being applied with material fluorescent to ultraviolet radiation in the approximate wavelength range of 3000 Å to 4000 Å on one side of a sheet of material transparent to visible light and ultraviolet radiation in the approximate wavelength range of 3000 Å to 4000 Å, but opaque to shorter wavelength ultraviolet radiation.

14. The apparatus of claim 13 wherein said first planar image is at least partially transparent.

15. The apparatus of claim 13 wherein said transparent sheet is made selectably transmissive to short wavelength ultraviolet radiation by perforating said transparent sheet.

16. The apparatus of claim 13 wherein said second type of visibly fluorescent object is further defined as a planar image which is a graphical representation of a subject to be displayed, said planar image being applied with material fluorescent to ultraviolet with a wavelength range centered around the 2537 Å emission peak for mercury vapor but which material is substantially unresponsive to ultraviolet radiation having wavelengths longer than about 3000 Å.

17. The apparatus of claim 16 wherein said second planar image is at least partially transparent.

18. The apparatus of claim 16 wherein said short-wave responsive planar image is applied to the front side of a second sheet of material placed behind said perforated sheet.

19. An article of manufacture comprising:

(a) a first perforated, visibly transparent sheet substantially opaque to short wavelength ultraviolet radiation having a wavelength range centered about the 2537 Å emission peak for mercury vapor, but substantially transmissive to ultraviolet radiation in the approximate range of 3000 Å to 4000 Å, (b) a first object or planar image visibly fluorescent to ultraviolet radiation in the approximate range of 3000 Å to 4000 Å affixed to the rear side of said first sheet, and (c) at least one alternate object or planar range visibly fluorescent to ultraviolet radiation having a wavelength range centered about the 2537 Å emission peak for mercury vapor, said alternate object or planar image positioned behind said first sheet.

20. The article of claim 19 wherein at least one of said first or alternate objects or planar images is at least partially transparent.

21. An article of manufacture comprising:

(a) a visibly transparent sheet substantially opaque to short-wavelength ultraviolet radiation having a wavelength range centered about the 2537 Å emission peak for mercury vapor, but substantially transmissive to ultraviolet radiation in the approximate range of 3000 Å to 4000 Å, (b) a first object or planar image visibly fluorescent to ultraviolet radiation in the approximate range of 3000 Å to 4000 Å affixed to the rear side of said sheet, and (c) a second object or planar image visibly fluorescent to short-wavelength ultraviolet radiation having a wavelength range centered about the 2537 Å emission peak for mercury vapor, but substantially unresponsive to longer wavelength ultraviolet radiation, affixed to the front side of said sheet.

22. The article of claim 21 wherein at least one of said first or second objects or planar images is at least partially transparent.

23. The article of claim 21 where said sheet is perforated.

24. The apparatus of claim 10 wherein said first type of ultraviolet radiation has one polarization sense, and said alternate type of ultraviolet radiation has a polarization sense orthogonal to the polarization sense of said first type of ultraviolet radiation.

25. The apparatus of claim 24 wherein said first type of ultraviolet radiation is further definded as being plane polarized, and said second type of ultraviolet radiation is further defined as being plane polarized at ninety degrees to the plane of polarization of said first type of ultraviolet radiation.

26. The apparatus of claim 25 wherein said means for selectably directing ultraviolet radiation from said first and second type ultraviolet radiation sources to said first and second types of visibly fluorescent objects comprises:

(a) means for making said first type of object responsive only to vertically polarized radiation, (b) means for making said second type of object responsive only to horizontally polarized radiation, and (c) means for selectably illuminating said first type and second type objects from said first and second radiation sources.

27. The apparatus of claim 26 wherein said means for making said first and second objects are made responsive only to vertically polarized and horizontally polarized radiation, respectively, comprises:

(a) a first perforated sheet polarizer with its polarization axis vertically oriented and positioned within the overlapping radiation fields of both said first and second radiation sources in front of said first type objects, and (b) a second sheet polarizer with its polarization axis horizontally oriented positioned behind said first objects, and in front of said second second type objects.

28. An apparatus for producing the visual sensation of apparent motion comprising:

(a) an ultraviolet energy source, (b) a rotatable plane polarizer mounted in front of said ultraviolet energy source, (c) means for rotating said polarizer, (d) at least one first type object visibly fluorescent to vertically polarized ultraviolet radiation and substantially unresponsive to horizontally polarized ultraviolet radiation, said first type object being positioned within the geometric radiation pattern of said ultraviolet energy source, and (e) at least one second type object visibly fluorescent to horizontally polarized radiation and substantially unresponsive to vertically polarized radiation, said second type object being positioned with the geometric radiation pattern of said ultraviolet energy source, whereby rotating said plane polarizer at least ninety degrees will cause said first and second type objects to alternately appear bright and dark.

29. The apparatus of claim 28 wherei said first type and second type objects are made responsive only to vertically polarized and horizonatally polarized ultraviolet radiation, respectively, by (a) a first perforated sheet polarizer with its polarization axis vertically oriented and positioned between said radiation sources and said first type objects, (b) a second sheet polarizer with its polarization axis horizontally oriented and positioned behind said first type objects, and in front of said second type objects.

30. An apparatus for producing the visual sensation of apparent motion comprising:

(a) at least one visibly transparent, ultraviolet-radiation-transmissive panel in optical contact with a first type of visibly fluorescent object, (b) at least one first type source of ultraviolet radiation adapted to coupling ultraviolet energy into the interior of said ultraviolet-radiation-transmissive panel, said energy being transmitted through the interior of said panel by total internal reflection and transmitted through said panel to said visibly fluorescent object by frustrated total internal reflection, (c) at least one second type of visibly fluorescent object, (d) at least one second type of ultraviolet radiation source adapted to floodlighting said second type of visibly flourescent object, (e) means for shielding said first type of visibly fluorescent object from ultraviolet radiation emitted by said second type ultraviolet radiation sources, and (f) means for sequentially energizing said first and second type ultraviolet radiation sources, whereby said first and second types of objects are made to sequentially and visibly fluoresce.

* * * * *